US012349849B2

(12) United States Patent
Longoria et al.

(10) Patent No.: US 12,349,849 B2
(45) Date of Patent: Jul. 8, 2025

(54) CLEANING APPARATUS WITH TOUCH-FREE PAD PICK UP AND RELEASE MECHANISM

(71) Applicants: Jose Longoria, Miami, FL (US); Joseph Fiore, Jr., Erie, PA (US)

(72) Inventors: Jose Longoria, Miami, FL (US); Joseph Fiore, Jr., Erie, PA (US)

( * ) Notice: Subject to any disclaimer, the term of this patent is extended or adjusted under 35 U.S.C. 154(b) by 0 days.

(21) Appl. No.: 17/977,477

(22) Filed: Oct. 31, 2022

(65) Prior Publication Data

US 2023/0048516 A1 Feb. 16, 2023

Related U.S. Application Data

(63) Continuation of application No. 16/891,739, filed on Jun. 3, 2020, now Pat. No. 11,517,175.

(60) Provisional application No. 62/856,866, filed on Jun. 4, 2019.

(51) Int. Cl.

| | |
|---|---|
| ***A47L 13/258*** | (2006.01) |
| ***A47L 13/16*** | (2006.01) |
| ***A47L 13/29*** | (2006.01) |
| ***A47L 13/46*** | (2006.01) |

(52) U.S. Cl.

CPC ..... *A47L 13/258* (2013.01); *A47L 13/16* (2013.01); *A47L 13/29* (2013.01); *A47L 13/46* (2013.01)

(58) Field of Classification Search

CPC ..... A47L 13/256; A47L 13/257; A47L 13/44; A47L 13/46; A47L 13/29; A47L 13/254–258

USPC ..... 15/231, 144.2

See application file for complete search history.

(56) References Cited

U.S. PATENT DOCUMENTS

| | | | | |
|---|---|---|---|---|
| 2,124,220 A * | 7/1938 | Winston | A47L 13/46 | 15/231 |
| 4,811,449 A * | 3/1989 | Kobayashi | A47L 13/44 | 15/231 |
| 7,640,617 B2 * | 1/2010 | Kennedy | A47L 13/20 | 403/90 |
| 8,464,391 B2 * | 6/2013 | Bober | A47L 13/258 | 15/228 |

FOREIGN PATENT DOCUMENTS

| | | | |
|---|---|---|---|
| KR | 200404304 Y1 * | 12/2005 | A47L 13/44 |

* cited by examiner

*Primary Examiner* — Laura C Guidotti

(74) *Attorney, Agent, or Firm* — Taylor Duma LLP

(57) ABSTRACT

A cleaning apparatus and related system is disclosed where the cleaning apparatus includes a one or more grabber that is actuated by a one or more slider such that the cleaning apparatus is moveable between a closed position and an open position. By moving the cleaning apparatus into the open position, a user is able to place the apparatus over a pad. Moving the apparatus into a closed position while over the pad causes the grabber to pinch the pad to the base, thereby securing it to the apparatus. When the user wishes to discard the pad, the apparatus is moved from the closed position to the open position, releasing the pad.

10 Claims, 31 Drawing Sheets

CLEANING APPARATUS WITH TOUCH-FREE PAD PICK UP AND RELEASE MECHANISM

CROSS-REFERENCE TO RELATED APPLICATIONS

This application is a continuation of, and claims priority to, non-provisional patent application Ser. No. 16/891,739 filed on Jun. 3, 2020, entitled "CLEANING APPARATUS WITH TOUCH-FREE PAD PICK UP AND RELEASE MECHANISM;" which is a non-provisional of provisional patent application No. 62/856,866, filed on Jun. 4, 2019, entitled "Mop with Pick Up and Release Feature" which is incorporated by reference as if fully set forth herein.

FIELD OF THE INVENTION

The invention disclosed broadly relates to the field of cleaning implements and, specifically, to cleaning implements that employ a disposable sheet or pad as the cleaning surface and having mechanical features integral thereto adapted for the touch-free pick up and release of the disposable sheet or pad.

BACKGROUND OF THE INVENTION

Cleaning implements in a myriad of forms are well known in the art. For example, mops, used to clean floors, are marketed in many forms and in a variety of configurations. Spurred on by an increased awareness of how bacteria breed and pathogens are transferred from surfaces to human hosts, the evolution of cleaning implements has led the art to find ways to make the dirty, or consumable, portions of cleaning implements, replaceable, while conserving the supporting structure. In the case of mops, for example, some include a mop head that accepts a dry or wet cleaning pad that is replaceable and disposable. Although these detachable pads are convenient, the installation can be cumbersome and require the user to load the cleaning pad by hand. In the case of the wet cleaning pad, loading the pad requires the user to touch the wet pad and the impregnated cleaning solution. After cleaning with these popular devices, the soiled pad must be removed manually. This removal of the soiled pad is undesirable as it requires the user to touch the soiled pad, thereby coming into physical contact with dirt, bacteria, and other pathogens.

There is, therefore, a long felt need in the art for a cleaning implement in the form of an apparatus that can both load and release a disposable cleaning pad or sheet without the user having to touch the pad at all.

SUMMARY

In view of the foregoing, the present invention is directed to a cleaning apparatus having mechanical features adapted to allow a user to open, grip, and secure a cleaning pad. After cleaning, the user can release the now dirty pad from the apparatus and dispose of it without having to touch the dirty pad.

In a non-limiting, preferred embodiment, a cleaning apparatus according to the present invention includes a base with a pair of opposing sliders that each actuate a corresponding grabber. The grabbers are mechanically biased to remain in a closed position but are actuated to an open position via a force applied by the user to the pair of opposing sliders.

The apparatus described here is different from conventional mops as well as disposable pad-based cleaning implements as may be known in the art. The apparatus has the ability to automatically pick up a pad and position it on the mop head for cleaning. It can also release it after the task is done. The unique design limits the need to touch the pads.

In use, a cleaning pad that is lying on a surface like the floor, a counter top, or the retail container it comes in, can be picked up by the apparatus described here. In the automated loading process, the pad is stretched neatly to cover the mop head and clamped so it can clean any surface including floors, baseboards, windows, counters, etc. . . . . The device has the ability to release the pad after the job is complete. The unique design allows the user to release the dirty pad without touching it.

In a preferred embodiment, the cleaning apparatus is substantially rectangular in overall shape and configuration, with the grabbers extending out from the long edge. This allows the device to grab the pad at the longest dimension, providing for the most secure grip. The long edge is also typically the edge that is exposed to the most force—in the direction of the cleaning stroke—and thus will hold the pad better.

Other non-limiting embodiments of the cleaning apparatus may place the grabbers along the short edges of the rectangle for other cleaning applications.

While the embodiments described herein are substantially rectangular and have a pair of sliders with a corresponding pair of grabbers, it is within the scope of the present invention that the cleaning apparatus may be configured in any number of shapes and with a plurality of sliders and grabbers. For example, a hexagonally shaped base may be desired with a grabber coincident with each side.

Similarly, while the preferred embodiment discloses two sliders working in unison to actuate two grabbers, it is contemplated that embodiments may employ one slider—or more than two sliders—to actuate a grabber or a plurality of grabbers.

The unique apparatus discussed herein can be marketed for multiple uses and configurations contemplated to be within the scope of the present invention, including, but not limited to, floor mopping, window washing, furniture dusting and even BBQ grill scrubbing. The "pads" that the disclosed invention can accommodate, can range from durable, reusable, or disposable custom pads, to ordinary wash cloths, scouring pads, or disposable paper towels.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

In this specification where a document, act, or item of knowledge is referred to or discussed, this reference or discussion is not an admission that the document, act, or item of knowledge or any combination thereof was, at the priority date, publicly available, known to the public, part of common general knowledge, or otherwise constitutes prior art under the applicable statutory provision; or is known to be relevant to an attempt to solve any problem with which this specification is concerned.

BRIEF DESCRIPTION OF THE DRAWINGS

To describe the foregoing and other exemplary purposes, aspects, and advantages, we use the following detailed description of an exemplary embodiment of the disclosure with reference to the drawings, in which.

Figure 1:
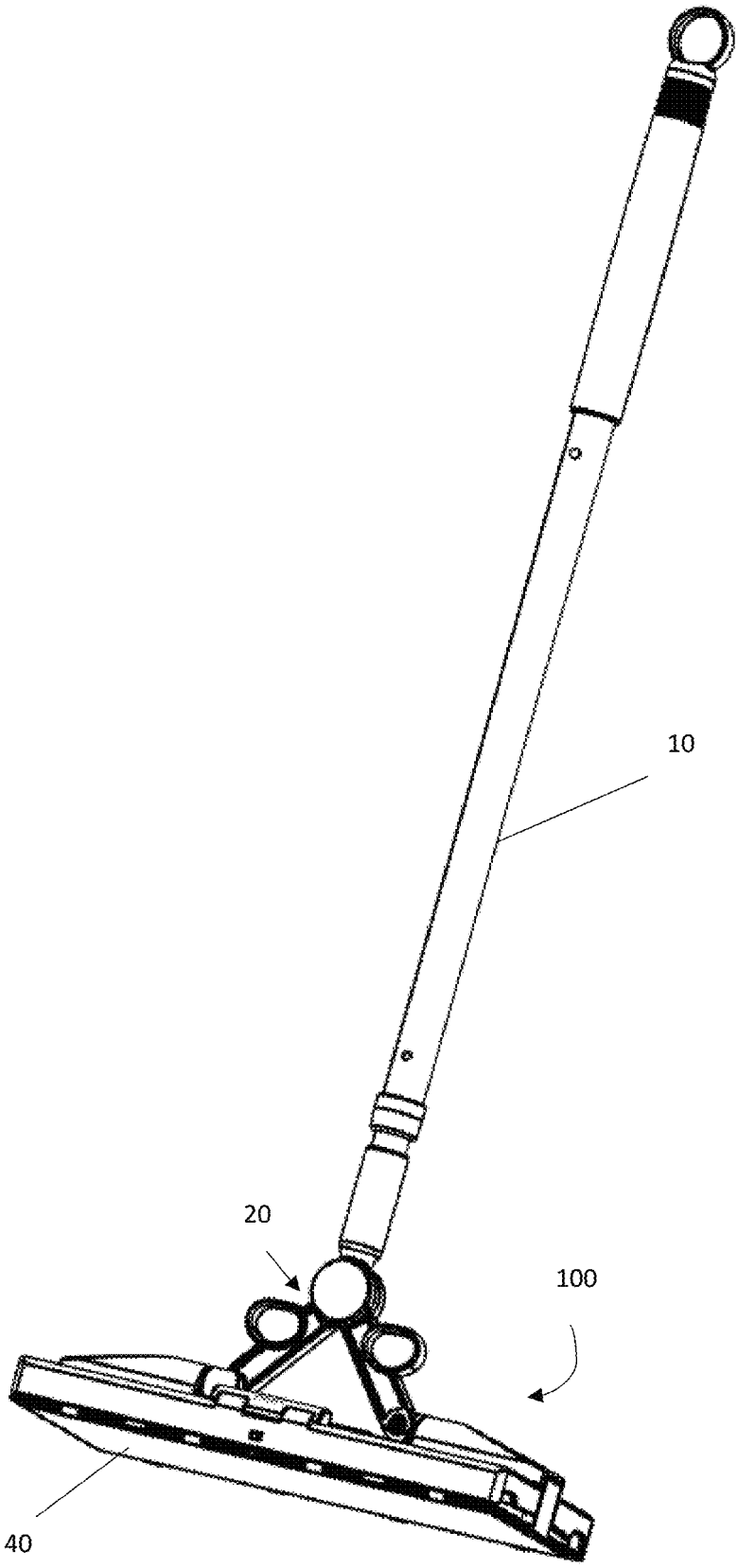
FIG. 1 shows an isometric view of a cleaning apparatus with a mop handle, actuator, and contact pad attached according to an embodiment of the invention.
Figure 2:
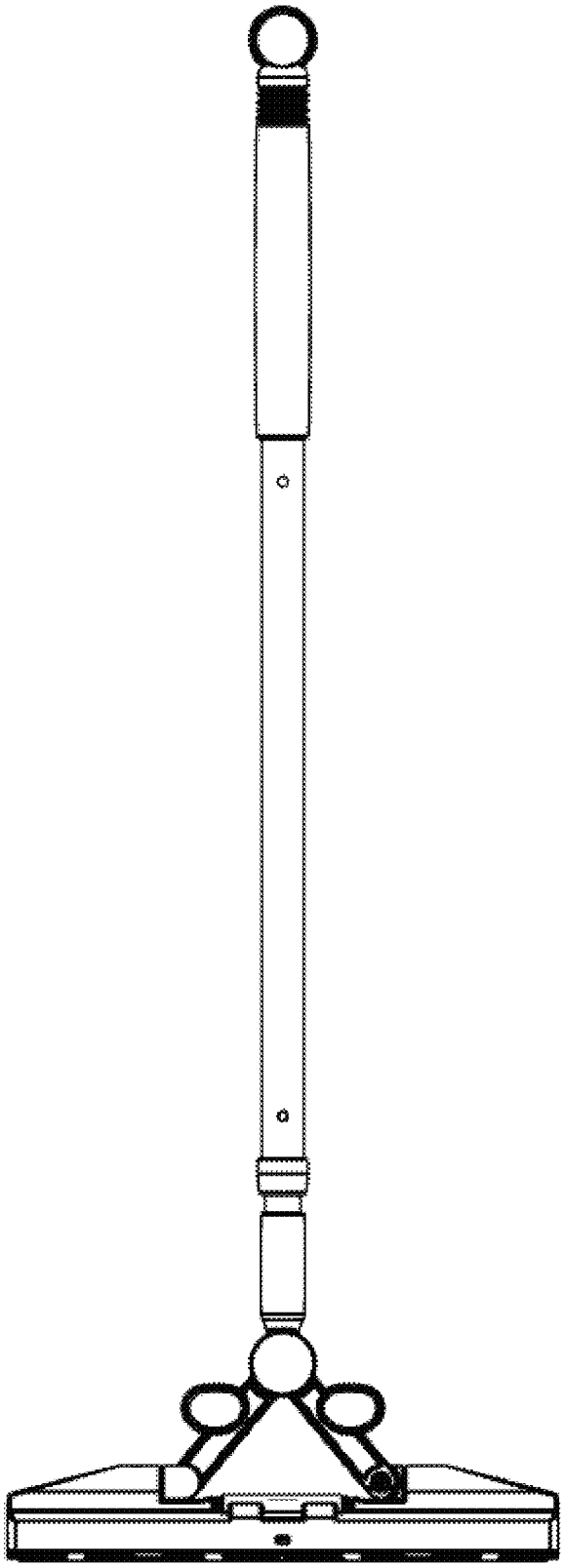
FIG. 2 shows a front view of the cleaning apparatus of FIG. 1, according to an embodiment of the invention, where the back view is the same as the front view.
Figure 3:
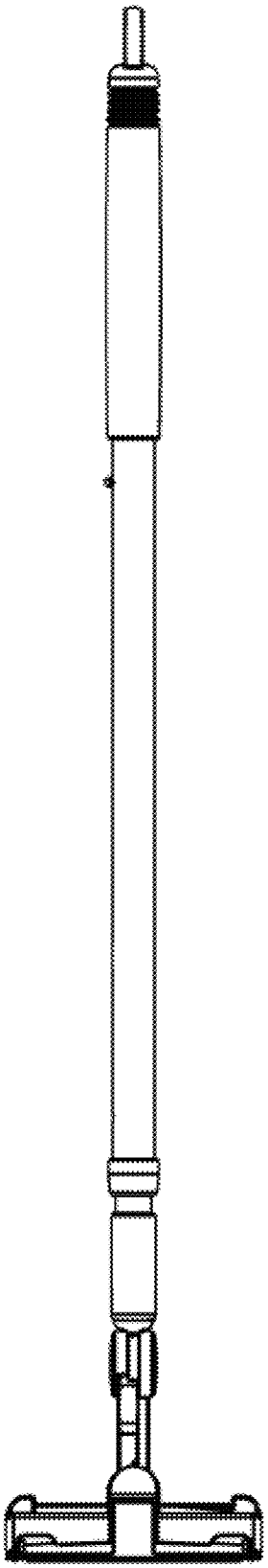
FIG. 3 shows a right view of the cleaning apparatus of FIG. 1, according to an embodiment of the invention, where the left view is the same as the right view.

While the invention as claimed can be modified into alternative forms, specific embodiments thereof are shown by way of example in the drawings and will herein be described in detail. It should be understood, however, that the drawings and detailed description thereto are not intended to limit the invention to the particular form disclosed, but to the contrary, the intention is to cover all modifications, equivalents and alternatives falling within the scope of the present disclosure.

DETAILED DESCRIPTION

In the Summary above, in the Description below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

As used herein, "mop" means a cleaning apparatus and is used interchangeably to describe an embodiment of the cleaning apparatus described herein and does not mean that the invention is limited to a floor cleaning apparatus at the end of a long handle. In fact, it is contemplated that the apparatus disclosed may be adapted to many different cleaning applications including, but not limited to, floor mopping, window washing, furniture dusting and even BBQ grill scrubbing. Indeed, the apparatus may be adapted to be used in any number of applications where a removable pad is desired to be used in a "touch-free" manner.

As used herein, "slider" means the component, or group of components, or portion of a component, that receives a force from the user in order to actuate one or more grabber. The slider may receive the force directly, or indirectly as, for example, via an attached linkage or actuator. It is contemplated that, in embodiments, the slider may translate (slide) or rotate while keeping within the intended scope such that the relative motion of a "slider" results in a translated motion of a "grabber."

As used herein, "grabber" means the component, or group of components, or portion of a component, that is directly or indirectly actuated by the slider, interfaces with the pad, and holds the pad onto the cleaning apparatus during use. Although the preferred embodiment describes two grabbers, it is contemplated that the function of the grabber may be accomplished using one grabber, two grabbers, or more than two grabbers.

As used herein, "pad" means a component that is attachable and removable from the cleaning apparatus that is useable for cleaning a surface. The term "cleaning pad" is interchangeable with the term "pad." By way of example and not limitation, a pad, as used herein, can be durable for multiple uses, or can be disposable for single, or limited, use. The pads may be general purpose for cleaning varied types of surfaces, or can be special purpose, such as for scouring grill grates. The pads, as described herein, however, preferably have at least a portion of their surface that is pliable, or compliant, such that the grabbers may contact the pad and pull it tight to the base via a pinching or clamping action.

The term "comprises" and grammatical equivalents thereof are used herein to mean that other components, structures, steps, etc. are optionally present. For example, an article "comprising" (or "which comprises") components A, B, and C can consist of (i.e., contain only) components A, B, and C, or can contain not only components A, B, and C, but also one or more other components or structures.

The term "at least" followed by a number is used herein to denote the start of a range beginning with that number (which may be a range having an upper limit or no upper limit, depending on the variable being defined). For example, "at least 1" means 1 more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40% means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

Before describing in detail embodiments that are in accordance with the present invention, it should be observed that some of the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

While the specification will conclude with claims defining the features of embodiments of the invention that are regarded as novel, it is believed that the invention will be better understood from a consideration of the following description in conjunction with the figures, in which like reference numerals are carried forward.

Cleaning Apparatus

Referring now to the figures in general and to FIG. 1, in particular, we disclose a cleaning apparatus 100 according to a non-limiting preferred embodiment of the present invention where the cleaning apparatus 100 is substantially rectangular in shape and is configured to clean primarily, but not exclusively, in a direction substantially perpendicular to the long edge. Optionally fitted with a long handle, the cleaning apparatus 100, as shown in FIG. 1, may be suitable, for example, to clean floors. As shown in FIGS. 6-10, the cleaning apparatus 100 comprises a base 110, an opposing pair of sliders 120, Left and Right (120L and 120R), an opposing pair of grabbers 130, Front and Rear (130F and 130R), an opposing pair of linkages 140, Left and Right (140L and 140R) and a spring element 150.

The base 110 provides the main structure to which the other components attach and has a top, bottom, right, left, front, and rear. The opposing pair of sliders 120 each are slidingly attached to the top of the base 110, one slider 120 attached proximate to the right side of the base 110 and the other slider 120 disposed opposite of the first slider, proximate to the left side of the base 110. These are referred hereinafter as the right slider 120R (proximate to the right side of the base) and the left slider 120L (proximate to the left side of the base). The opposing pair of grabbers 130 are each slidingly communicative with the top of the base 110, one grabber disposed proximate to the front of the base 110 and the other grabber disposed opposite to the first grabber and proximate to the rear of the base 110. These are referred hereinafter as the front grabber 130F (disposed proximate to the front of the base 110) and the rear grabber 130R (disposed proximate to the rear of the base 110). Attached between the sliders 120 and grabbers 130 is an opposing pair of linkages 140 where, 140R is on the right, and 140L is on the left.

Base

The base 110 is preferably manufactured out of a durable injection molded plastic, although one skilled in the art will appreciate that the base 110 may be manufactured using a variety of materials and/or manufacturing methods to suit the intended use, price point, or other criteria.

Figure 11:
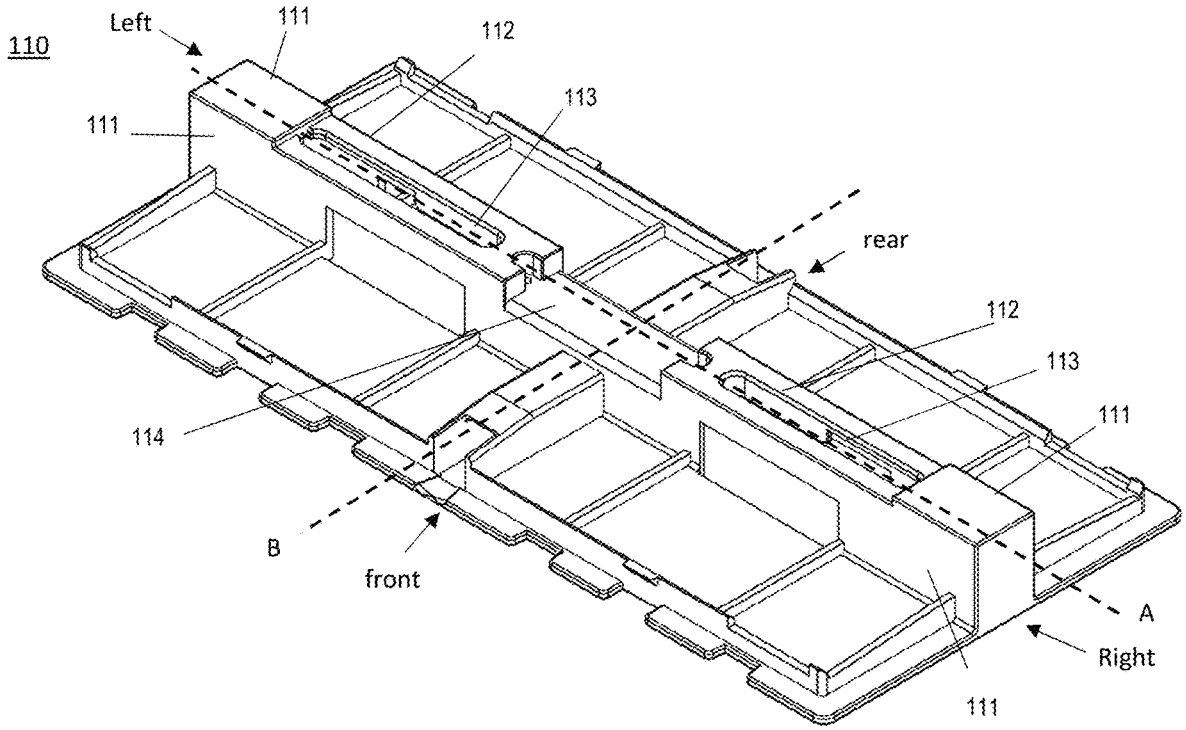
FIG. 11 shows a top isometric view of the base of the cleaning apparatus, according to an embodiment of the invention.
Figure 12:
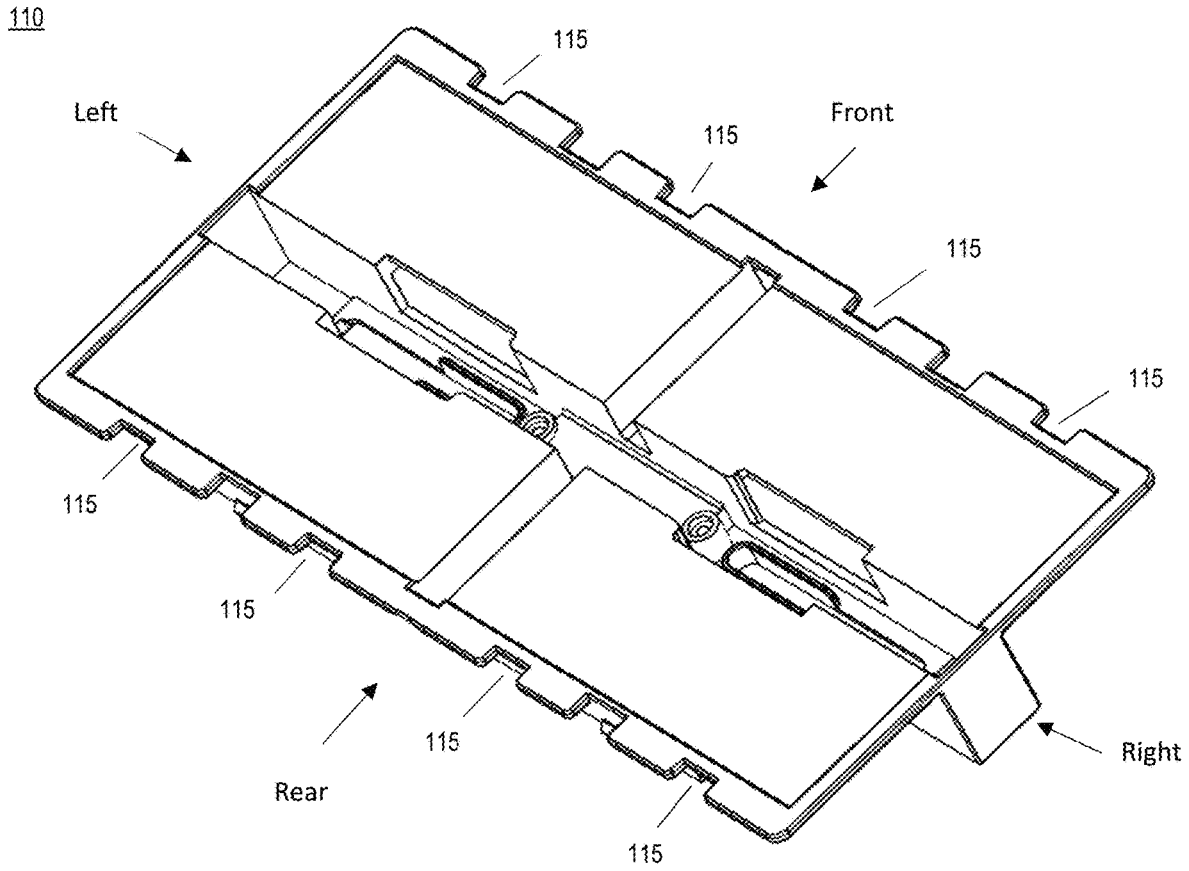
FIG. 12 shows a bottom isometric view of the base of the cleaning apparatus, according to an embodiment of the invention.

As shown in FIGS. 11 and 12, a preferred embodiment of the base 110 is a substantially rectangular component having a top, a bottom, a left side, a right side, a front, and a rear. A raised protrusion 111 extends along the top from the left to the right substantially along a longitudinal centerline A bisecting the base 110 between the front and rear. This raised protrusion 111 has a pair of sliding surfaces 112 and slots 113 to which each slider 120 is slidingly mated and constrained to slide longitudinally along the raised protrusion 111.

Figure 4:
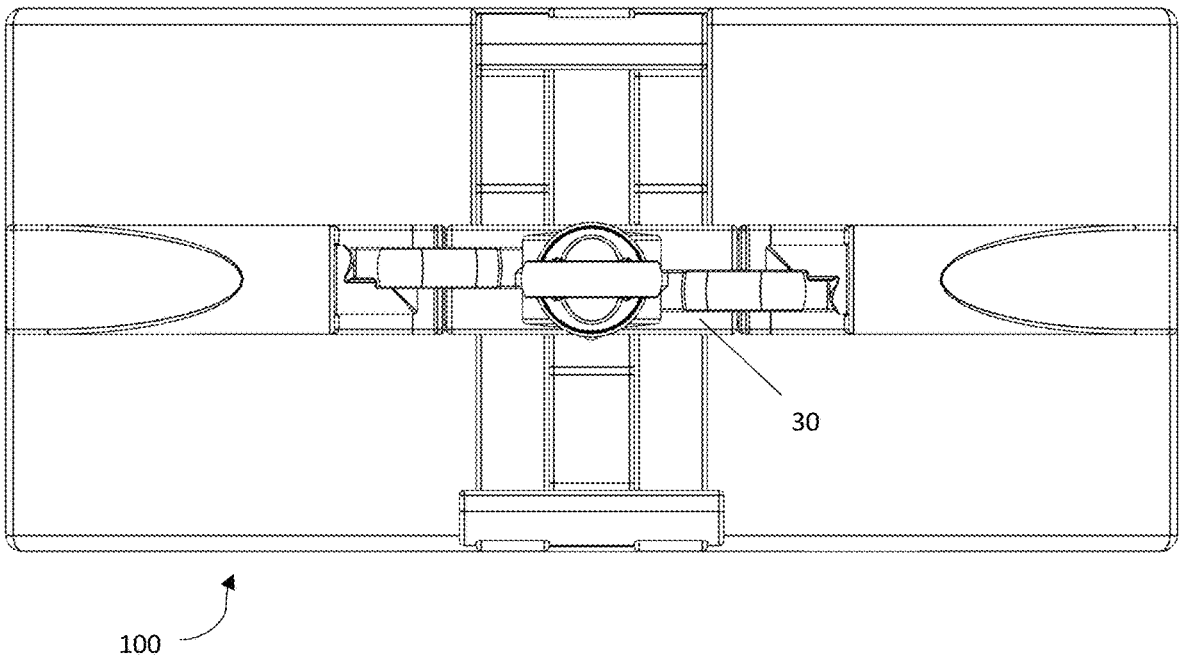
FIG. 4 shows a top view of a cleaning apparatus, according to an embodiment of the invention.

A recessed portion 114 in the raised protrusion 111 is centered about a transverse centerline B bisecting the base 110 between the right and the left sides. This recessed portion 114 defines a track and surface over which a portion of the grabbers 130 slide as they translate between the open and closed positions. Optionally, a retainer 30 (see FIG. 4) can be fixedly attached to the base 110 in order to maintain the grabbers 130 in sliding relation to the base 110 at this recessed portion 114.

Non-limiting embodiments of the base 110 may additionally have one or more of other features such as: structural ribs for rigidity; slots and/or channels for component placement; or mating features, such as notches 115 (see FIG. 12), to accept protrusions from the grabber(s) 130 in inserted relation.

Figure 5:
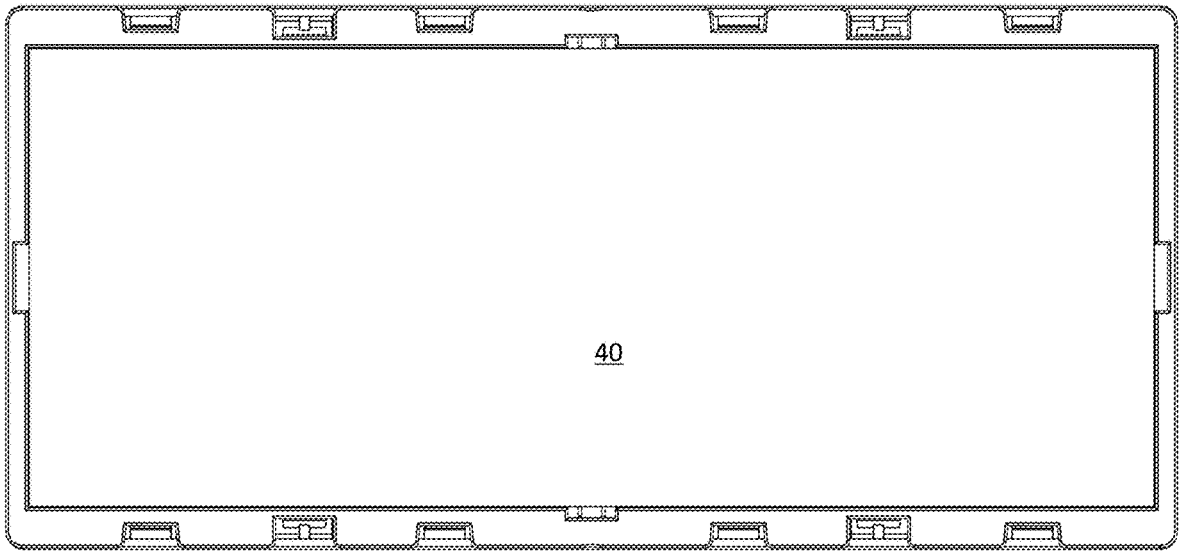
FIG. 5 shows a bottom view of a cleaning apparatus, according to an embodiment of the invention.

In other embodiments, the base 110 may further comprise a contact pad 40 (see FIGS. 1 and 5) in mated relation to the bottom of the base 110 that is of a different durometer (preferably a softer durometer) than the base 110 itself, thereby providing a compliant surface between the base 110 and an attached cleaning pad (not shown).

As discussed in other sections of this disclosure, the embodiments of the base 110 may be configured to have other geometries—including other polygons, circles, ovals, or amorphous shapes—even though we disclose a substantially rectangular shape for compactness of disclosure.

Slider

The slider 120 is preferably manufactured out of a durable injection molded plastic, although one skilled in the art will appreciate that the slider 120 may be manufactured using a variety of materials and/or manufacturing methods to suit the intended use, price point, or other criteria.

Figure 13:
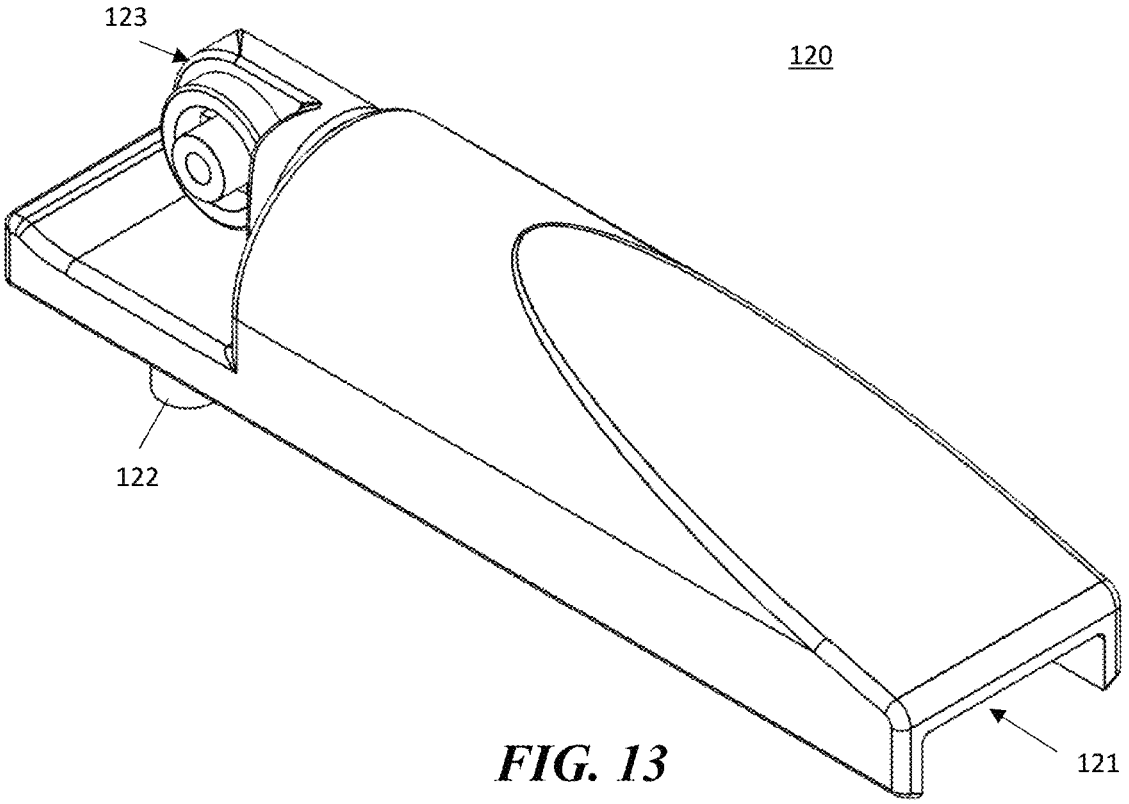
FIG. 13 shows a top isometric view of a slider of the cleaning apparatus, according to an embodiment of the invention.
Figure 14:
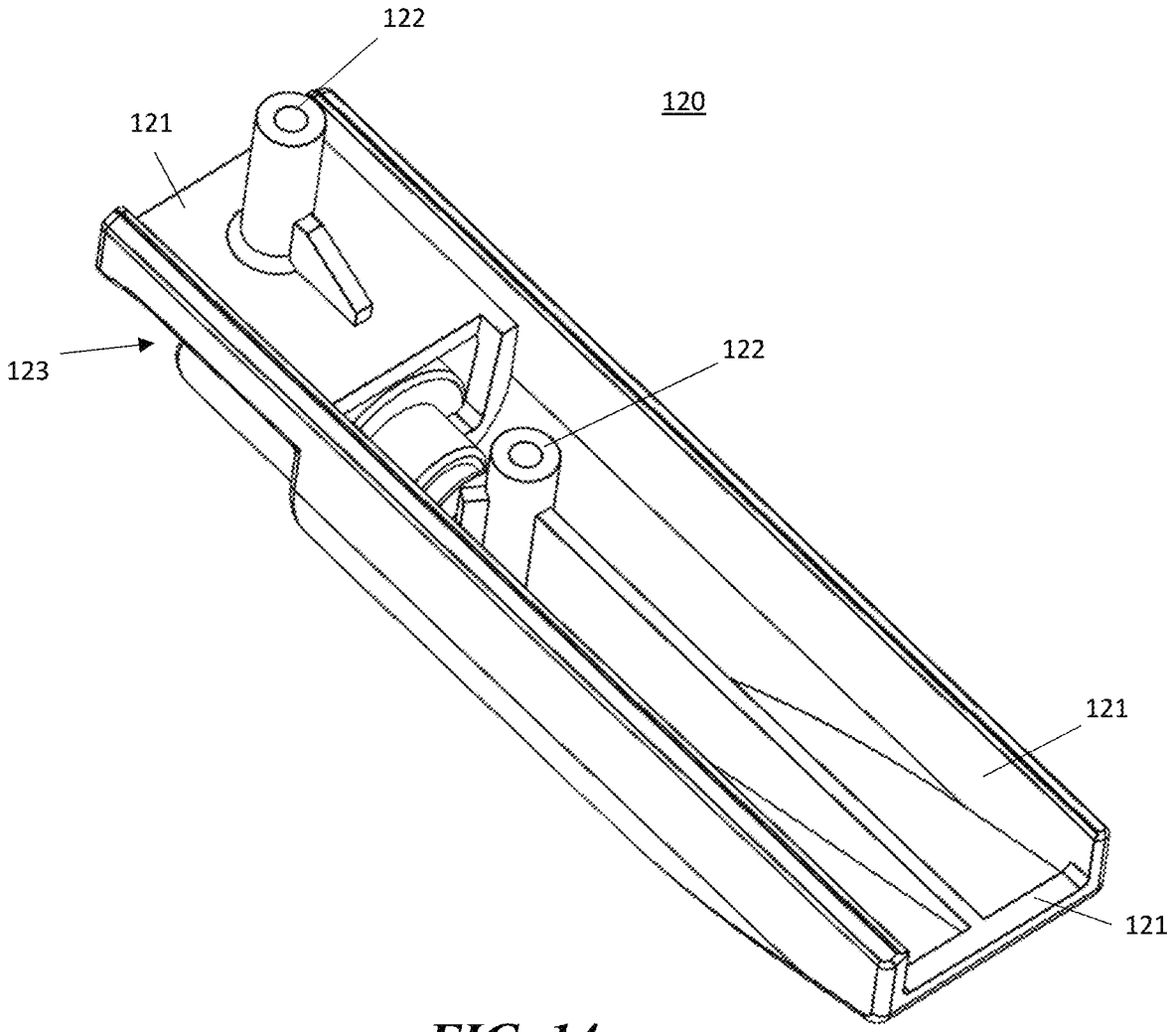
FIG. 14 shows a bottom isometric view of a slider of the cleaning apparatus, according to an embodiment of the invention.

As shown in FIGS. 13 and 14, a preferred embodiment of the slider 120 includes a track portion 121 and an attach portion 122 disposed on the bottom of the slider 120, and an actuation point 123 disposed on the top of the slider 120. The actuation point 123 is the area of the slider 120 where a user may exert a force in order to translate the slider 120 longitudinally relative to the base 110. In embodiments, the user may apply the force directly to the slider 120, or as shown in FIG. 1, the force may be applied by transferring a load through a separate attached component, such as an actuator 20.

The track portion 121 is configured to be slidingly mated with the raised protrusion 111 of the base 110. The attach portion 122, shown in FIG. 14 as a cylindrical protrusion, is configured to be slidingly communicative with the slot along the raised protrusion 111 of the base 110. When the slider 120 is assembled onto the base 110, the slider 120 is able to translate longitudinally relative to the base 110, on the raised protrusion 111. The length of travel of the slider 120 is constrained by the length of the slot 113 in which the attach portion 122 of the slider 120 travels.

One skilled in the art will appreciate that the slider 120 is constrained to track longitudinally along the raised protrusion 111 of the base 110 by the track portion 121 of the slider 120 and a mechanical constraint in sliding communication between the base 110 and the slider 120. By way of example and not limitation, a screw with a washer may be threaded into the cylindrical protrusion (the attach portion 122) in order to keep the slider 120 assembled onto the base 110. Snaps, clips, or other equivalent structures may accomplish the same function and be within the scope of the present invention.

FIGS. 1-10 show the use of two sliders 120 in the preferred embodiment. A force applied by the user to an actuator 20 (FIGS. 1-5) can be split between a left slider 120L and a right slider 120R in order to translate them along the base 110 as discussed (illustrated in FIG. 9).

Grabbers

The grabber 130 is preferably manufactured out of a durable injection molded plastic, although one skilled in the art will appreciate that the grabber 130 may be manufactured using a variety of materials and/or manufacturing methods to suit the intended use, price point, or other criteria.

Figure 15:
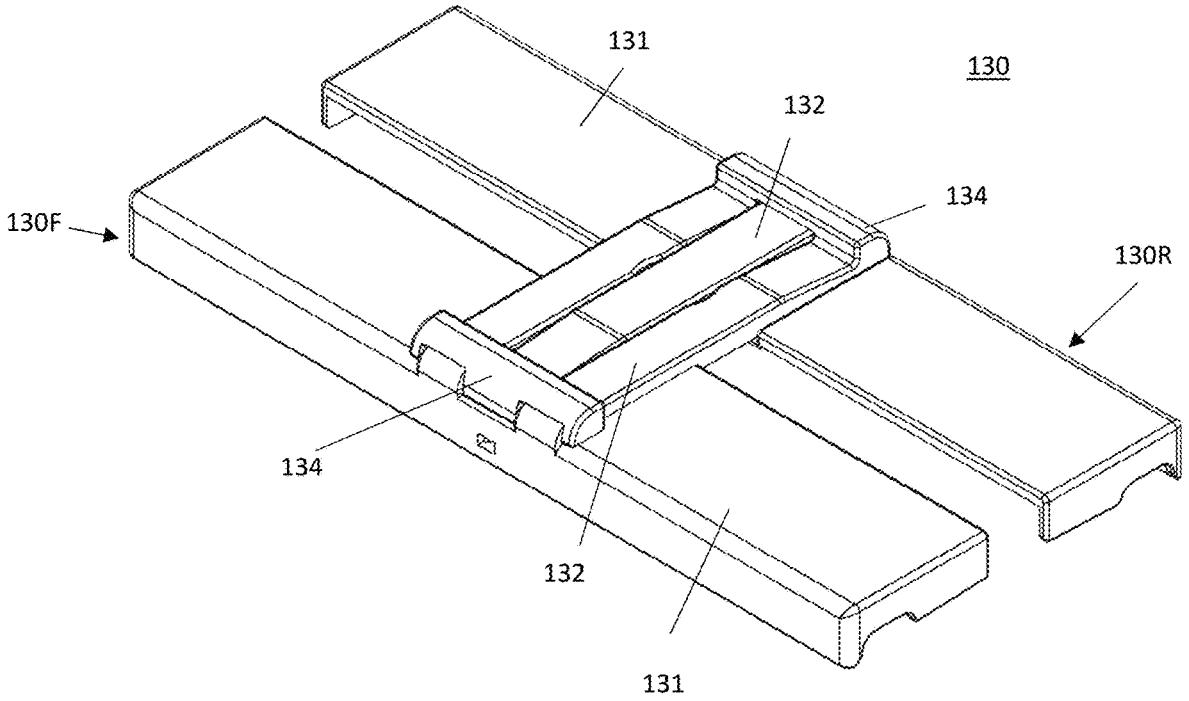
FIG. 15 shows an isometric view of a pair of grabbers of the cleaning apparatus in the closed state, according to an embodiment of the invention.
Figure 16:
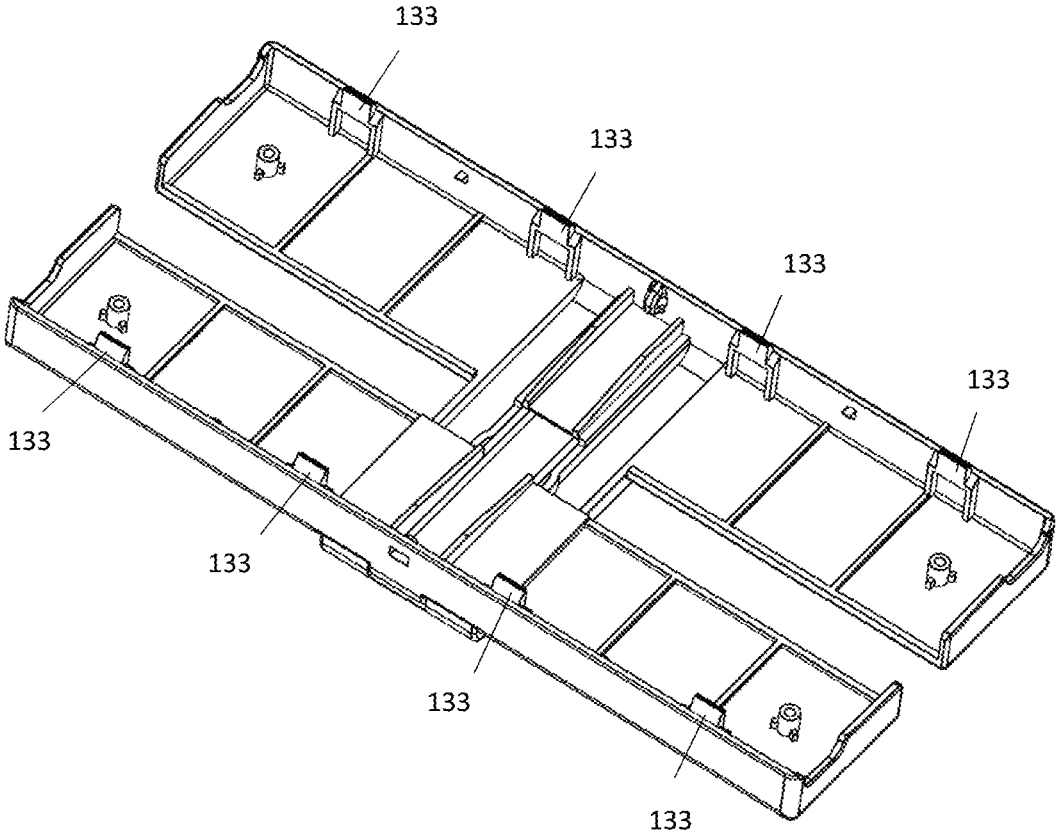
FIG. 16 shows a bottom isometric view of a pair of grabbers of the cleaning apparatus in the closed state, according to an embodiment of the invention.
Figure 17:
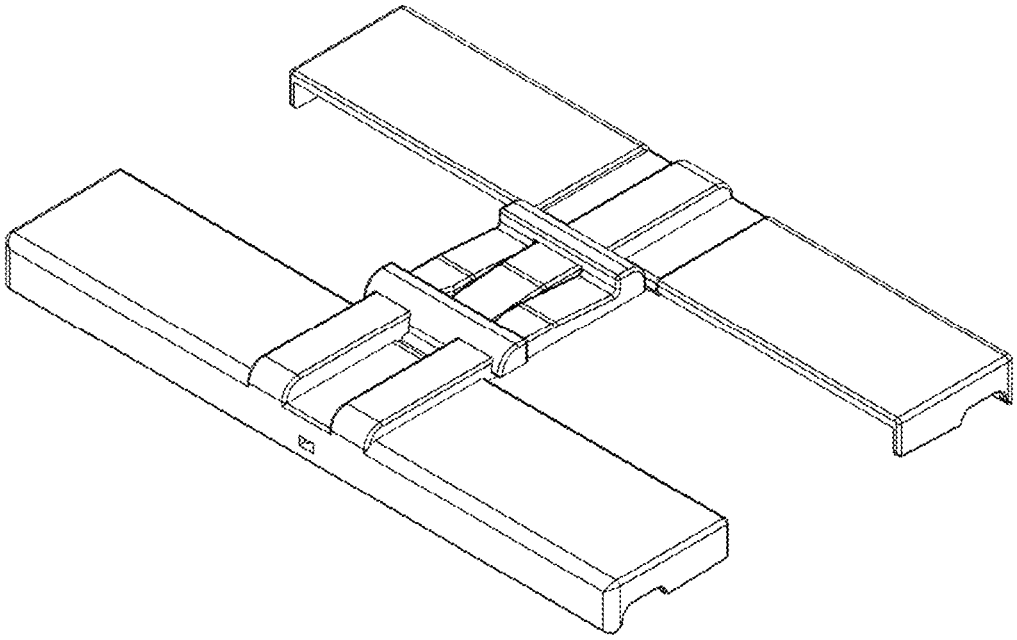
FIG. 17 shows an isometric view of a pair of grabbers of the cleaning apparatus in the open state, according to an embodiment of the invention.
Figure 18:
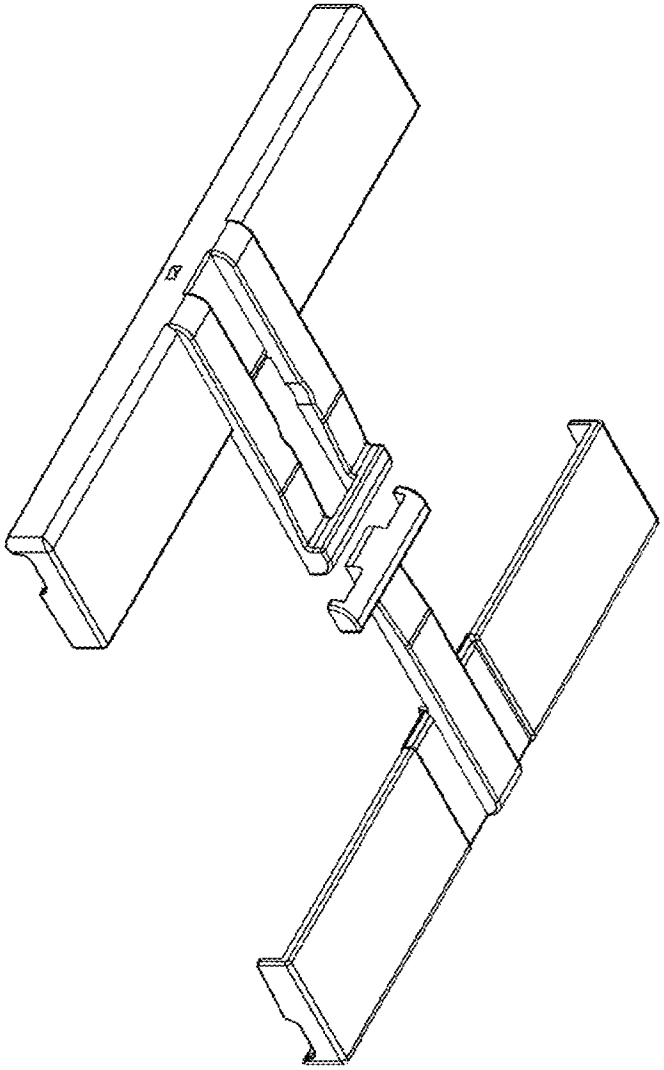
FIG. 18 shows an exploded isometric view of of a pair of grabbers of the cleaning apparatus, according to an embodiment of the invention.

As shown in FIGS. 15-18, a preferred embodiment of the grabber 130 has a body 131 and a tail 132. Longitudinally, the body of the grabber 130 is configured to extend substantially along the length of the base 110 from the left side to the right side of the base 110. Transversely, the body of the grabber 130 is configured to extend proximally from a distance offset from the raised protrusion 111 of the base 110 and distally to a distance offset from the base 110 such as to create an overhang past the base 110. On the portion of the grabber body that overhangs the base 110 is disposed a one or more gripping feature, hereinafter referred to as a one or more "gripper" 133. FIG. 16 illustrates a preferred embodiment of the grabber 130 with a plurality of grippers 133 in the shape of toothed protrusions extending down from the overhang portion of the grabber body 131.

Embodiments of the present invention contemplate that other types of structures may be utilized instead of the tooth-shape grippers 133 shown in FIG. 16. By way of example, and not limitation, the gripper may have a different cross-sectional profile. Alternatively, the gripper 133 may be a ridge or series of ridges along the length of the grabber 130. In yet other embodiments, the gripper may be an in-mold texture or an inserted component such as a rubber strip.

Centered substantially along the transverse centerline of the grabber body 131 extends a tail 132 protruding transversely to the body of the grabber 130. The tail extends from the body, away from the grippers, ending at a distance offset from the body 110 and past the distal side of the raised protrusion 111 along the top of the body 110. The tail 132 portion may be comprised of one or more protrusions.

The tail 132 portion of the grabber 130 is shaped with one or more ramped, or sloped surfaces. These ramped surfaces interact via the tail end 134 and allow the grabber 130 to slide transversely from the base 110, while simultaneously dipping down towards the base bottom as it extends past the end of the base 110. This "out and down" trajectory allows the grippers 133 to descend down past the bottom of the base 110 in order to contact and interact with a pad (not shown) that is held down beneath the base 110. It is important to note that the grippers 133 protrude past the bottom of the base 110 when "open" but don't protrude past the bottom of the base 110 when "closed." This way the grippers 133 can grip the pad when open, but do not touch or scratch the floor when closed.

Figure 6:
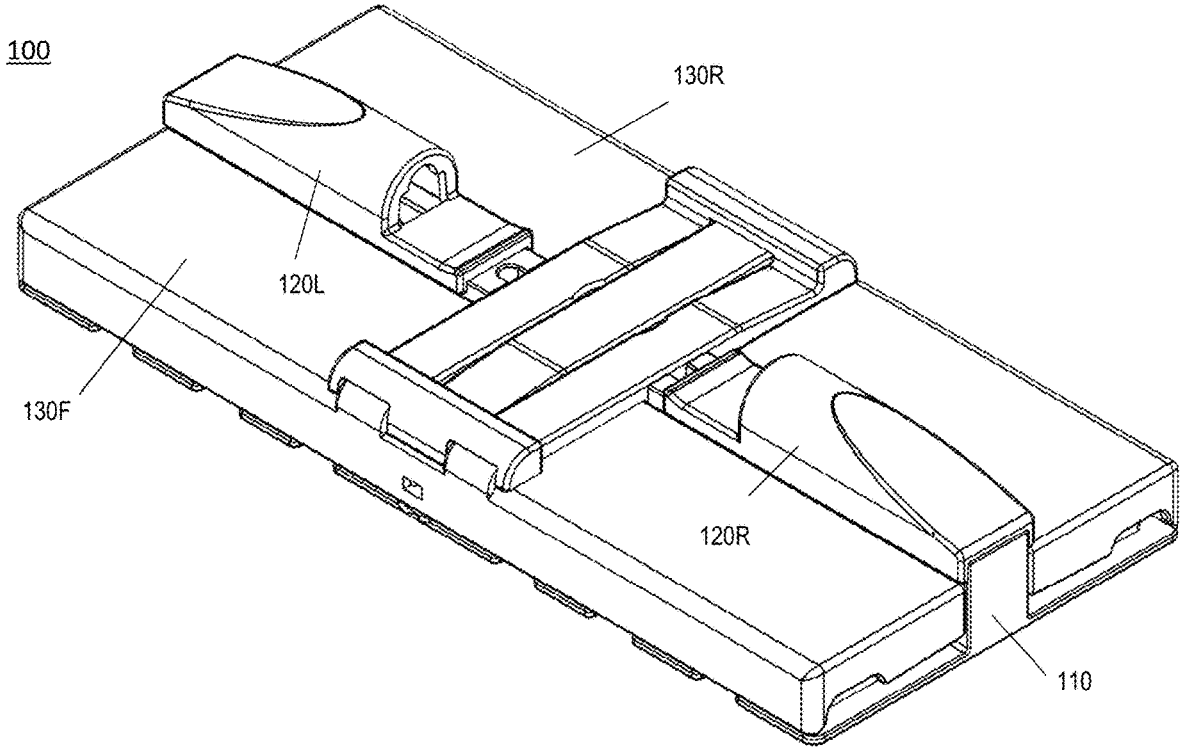
FIG. 6 shows an isometric view of the cleaning apparatus in a closed state, according to an embodiment of the invention.

As can be seen in FIG. 6, the tail of the grabber 130 rides in a recessed portion of the raised protrusion 111 of the base 110 and can be held in relation to the base 110 by a retainer 30, as described above.

The grabbers 130 also are operatively connected to the sliders 120 such that as the sliders 120 are translated along their track, the relative motion of the slider 120 with respect to the base 110 is translated into a corresponding motion of the grabbers 130. Normally, the sliders 120 are in a starting position corresponding to the grabbers 130 being in a closed position. As the sliders 120 are moved to an ending position the grabbers 130 likewise translate to an open position (see FIG. 9).

In a preferred embodiment, as can be seen in FIG. 6, the cleaning apparatus 100 has two grabbers 130: a front grabber 130F, and a rear grabber 130R. In this embodiment, the front grabber 130F and the rear grabber 130R operate cooperatively to open and close in a synchronized movement provided by the linked left slider 120L and right slider 120R. The front grabber 130F is configured with a single-protrusion tail, while the rear grabber 130R is configured with a two-protrusion tail. The tails of each grabber 130 are configured to nest together and provide additional "riding surfaces" for their relative trajectories.

In embodiments, such as is shown in FIGS. 6 and 15, the grabber tail 132 terminates in a stop feature 134. The stop feature 134 lends additional stability to the grabber trajectory while also providing a limiter feature to control the travel distance of the grabber 130.

In other embodiments, the grabber 130 or grabbers have detent features to hold the grabbers 130 in either the open position, or the closed position, or both.

Further embodiments also include grabbers 130 with snaps, tabs, slots, or other features to constrain the relative position of the grabber 130 with respect to the base 110 in the assembled state.

Linkage

The linkage 140 is preferably manufactured out of a durable injection molded plastic, although one skilled in the art will appreciate that the linkage 140 may be manufactured using a variety of materials and/or manufacturing methods to suit the intended use, price point, or other criteria.

Figure 7:
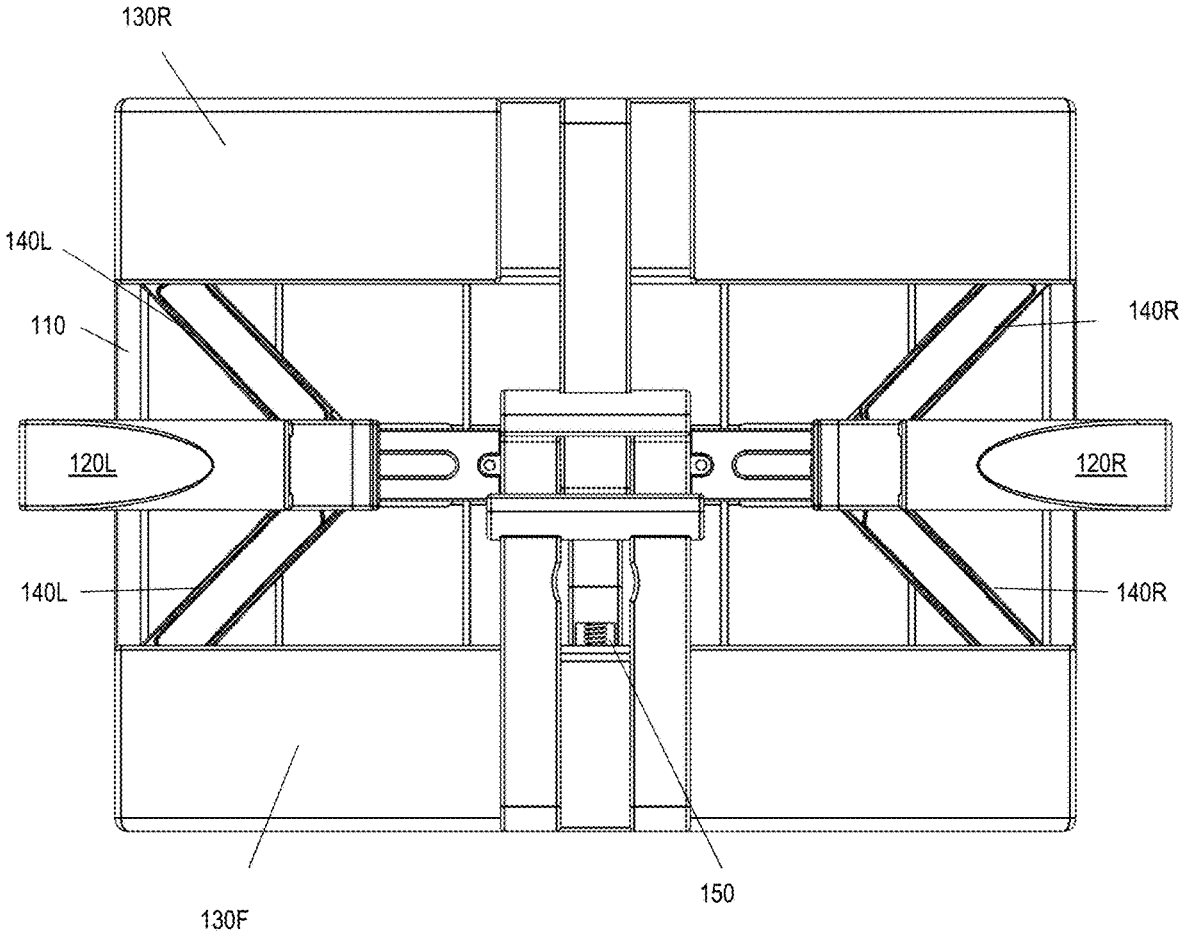
FIG. 7 shows a top view of the cleaning apparatus in the open state, according to an embodiment of the invention.
Figure 8:
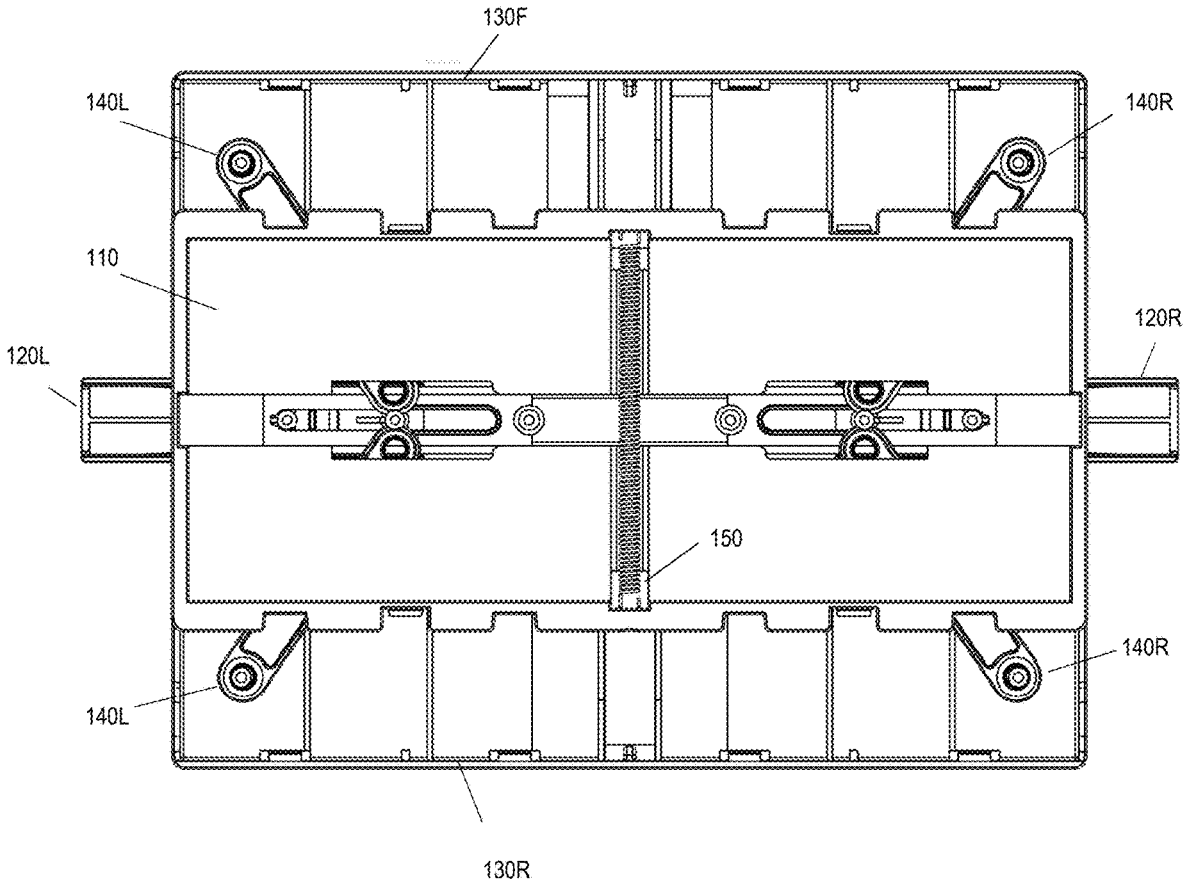
FIG. 8 shows a bottom view of the cleaning apparatus in the open state, according to an embodiment of the invention.
Figure 9:
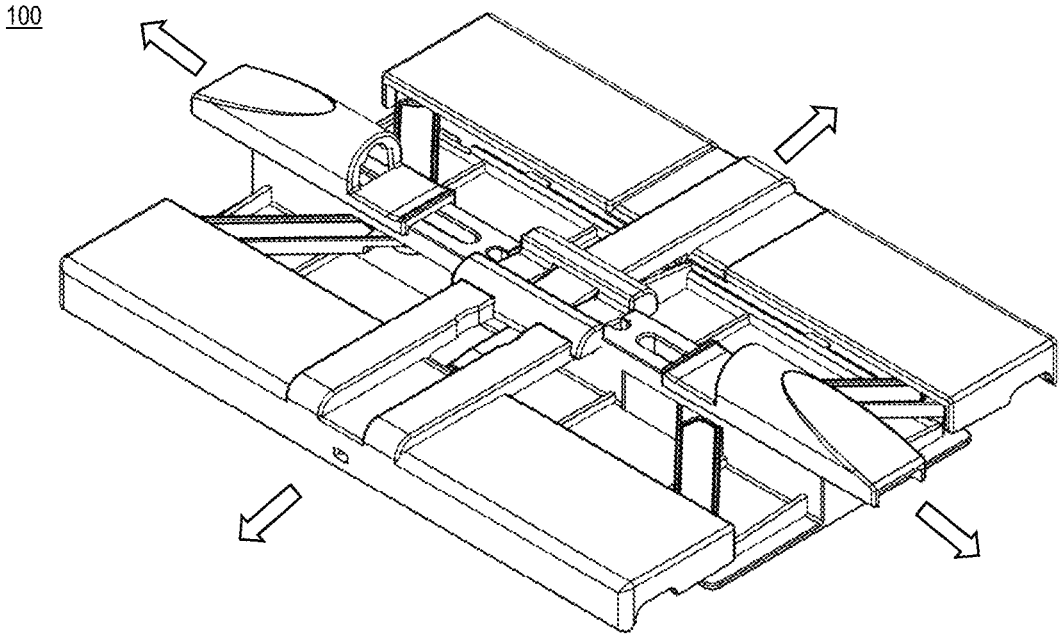
FIG. 9 shows an isometric view of the cleaning apparatus in the open state, with arrows depicting the relative motion of the components, according to an embodiment of the invention.
Figure 10:
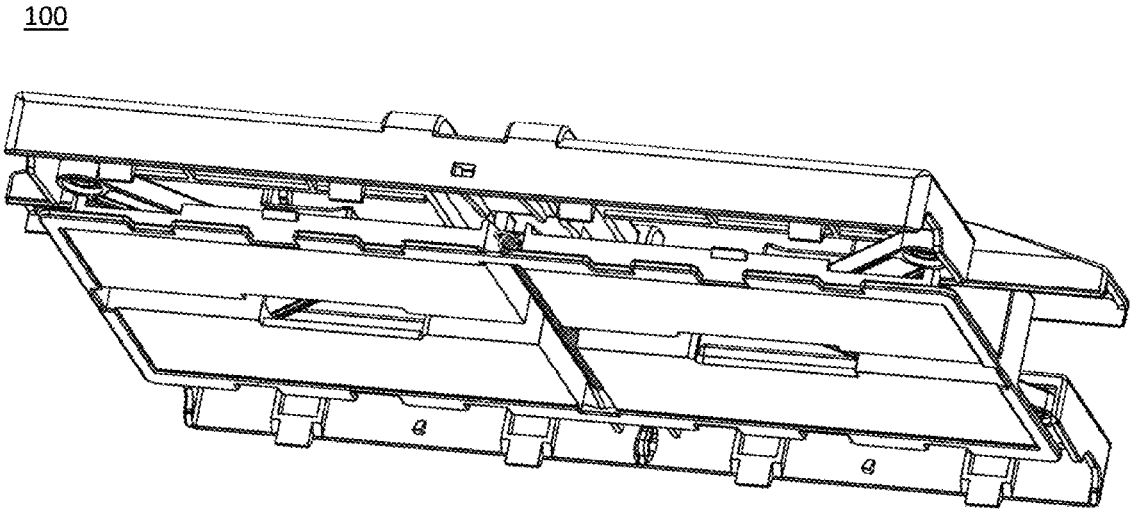
FIG. 10 shows a bottom isometric view of the cleaning apparatus in the open state, according to an embodiment of the invention.

As shown in FIGS. 7-9, a preferred embodiment of the linkage 140 provides a proximal pivot point, a distal pivot point, and a linkage body disposed between them. The linkage 140 can include two or more linked elements as shown in the figures. In the preferred embodiment of the cleaning apparatus 100, the linkage 140 is comprised of two link members. One link member connects a slider 120 to the front grabber 130F and the second link member connects the slider 120 to the rear grabber 130R.

In the embodiment shown in the figures, the front grabber 130F and rear grabber 130R are connected to the slider 120 at the same point—both links share one coaxial connection to the pivotable connection point on the slider 120. In other embodiments, the links may connect to different points on the slider 120 and provide equivalent results.

The linkage 140, comprised of the two links attached to the left slider 120L is hereinafter referred to as the left linkage 140L, and the two links attached to the right slider 120R is hereinafter referred to as the right linkage 140R.

While the embodiment shown in the figures depicts a linkage 140 comprised of two link members, it is contemplated to be within the scope of the present invention that the linkage 140 can also be one molded or formed component that deforms under the force applied to the slider 120 but then returns back to its "resting" state when the force is removed. Embodiments of the cleaning apparatus 100 that utilize this type of linkage 140 can remove the need for a separate spring element.

Figure 28:
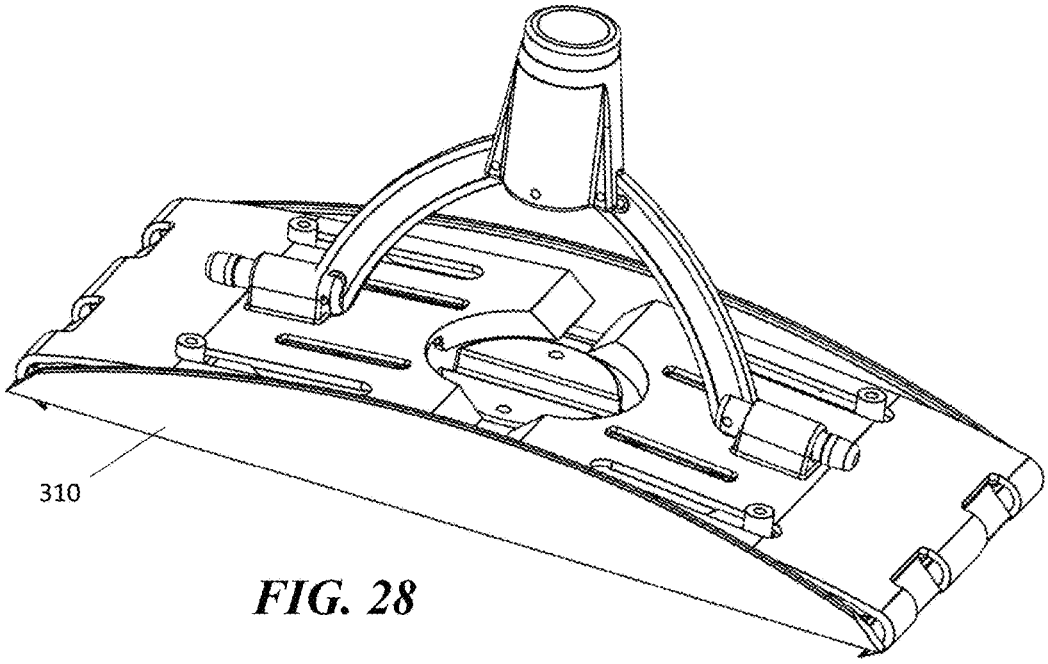
FIG. 28 shows the cleaning apparatus of FIG. 27 with the top cover removed, according to an embodiment of the invention.
Figure 29:
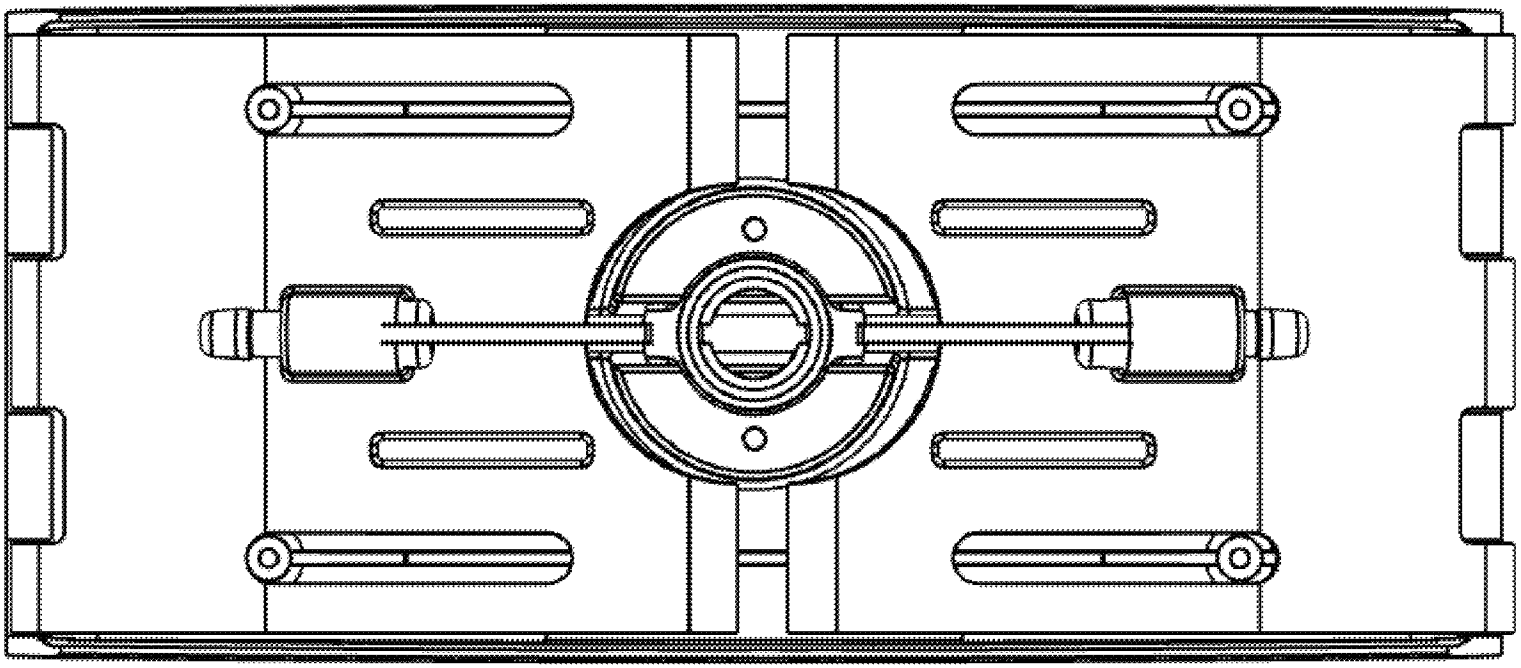
FIG. 29 shows a top view of the cleaning apparatus of FIG. 27, with the cover removed.
Figure 30:
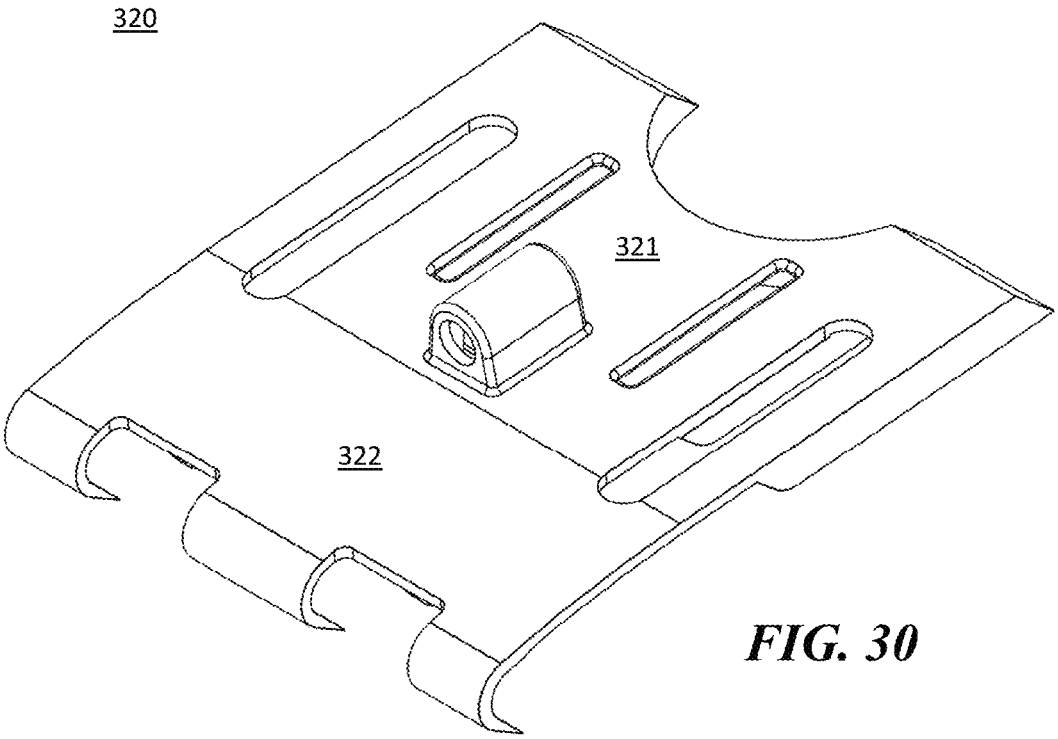
FIG. 30 shows a top isometric view of grabber/slider components, according to an embodiment of the invention.
Figure 31:
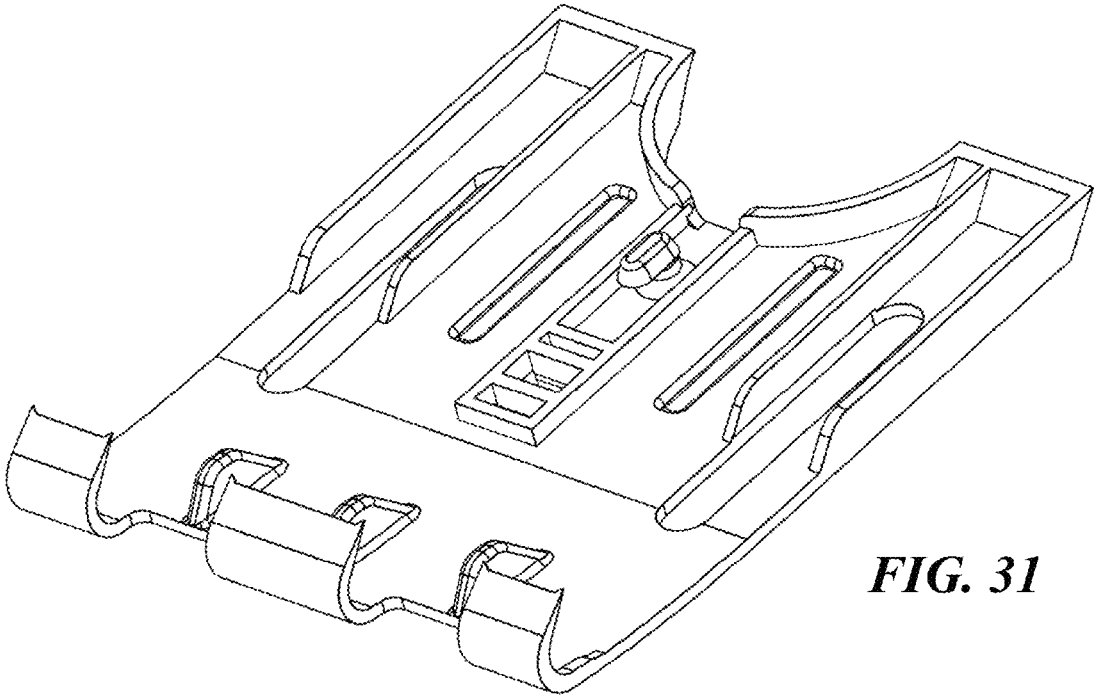
FIG. 31 shows a bottom isometric view of grabber/slider components, according to an embodiment of the invention.

Similarly, in embodiments where the grabber and slider are two portions of a unitary component, a separate linkage component is not required between the slider portion and grabber portion (see, for example, FIG. 28).

Spring Element

The spring element 150 is preferably a commonly known coiled extension spring made of spring steel, although one skilled in the art will appreciate that the spring 150 may be manufactured using a variety of materials and/or manufacturing methods to suit the intended use, price point, or other criteria.

While the invention is capable of operating independent of a spring element, the preferred embodiment, described here, utilizes a spring element in order to automate the closing of the grabbers 130. As shown in FIG. 8, a preferred embodiment of the spring element 150 is an extension spring having one end connected to the front grabber 130F and the other end connected to the rear grabber 130R. The spring element 150 is preferably chosen to remain under tension when the grabbers 130 are in the closed position. In this way, the spring element 150 is constantly trying to keep the grabbers 130 closed, thereby maintaining a clamping force on the pad.

Embodiments of the present invention may comprise one or more extension spring in tension in order to distribute the load pulling on the grabbers 130. Other embodiments of the cleaning apparatus 100 may employ one or more spring elements 150 disposed between the grabber 130 and the base 110 in order to provide the clamping force.

In embodiments where the spring element 150 is an extension spring and the grabbers 130 ride on each other's sloped tail (as is shown in the preferred embodiment apparatus 100, for example), placing the extension spring below the point at which the two tails of the grabbers 130 intersect and ride on each other, creates an over-center spring force. This encourages the grabbers 130 to dip down below the bottom of the base 110 at their extension (the open state) and to ride up above the bottom of the base 110 at their retracted position (the closed state).

Yet other embodiments may utilize one or more torsion springs at the pivots of the linkages 140 or extension springs between the pivot arms of the linkages 140 in order to exert the clamping force.

In all embodiments, the spring element 150 is a structure that imparts a biasing force to maintain the grabbers 130 in a "normally closed" position, but that can be overcome by applying a sufficient "opening force" to the slider or sliders 120.

Actuator

In embodiments, the force applied to the one or more slider 120, may be applied via an actuator 20. As used herein, the actuator 20 is a component, or assembly of components, that serves the function of transferring a load (an actuating load) into the one or more slider 120. By way of example, and not limitation, the actuator 20 may be a mechanical component, a motorized component, a servo mechanism, or other mechanical or electromechanical actuating device. Additionally, the actuator 20, may be actuated by direct means (a user applying a direct force) or remotely (a user pressing a remote button, or sending a wireless command that is received and acted on by the actuator 20).

The actuator 20 may be configured as a single component, a linkage, or other suitable configuration in order to transfer a load into the one or more slider 120. The example embodiment shown in FIG. 1, discloses an actuator 20 that is composed of two linkages with a common pivot point to which the handle 10 attaches, a finger-hold opening for the user to grab on each linkage, and a rotating pivot attachment at each slider 120 in order to transfer the load. The actuator 20, shown in the figures, is configured mechanically to also act as a "universal joint" between the base 110 and the handle 10. The configuration shown in FIG. 1, for example, permits the "mop head assembly" (comprising: sliders 120, grabbers 130, and base 110), to rotate about an axis parallel to the longitudinal centerline of the base 110, as well as, to rotate about an axis parallel to the transverse centerline of the base 110. An optional third axis of rotation is possible about the central axis of the handle 10.

Example 1

The cleaning apparatus 100 is held above a clean pad (shown in FIG. 26A through FIG. 26G). The user pushes down on the actuator 20 which causes the left and right sliders 120 to slide out along the base 110 away from the center of the base 110. The movement of the sliders 120 transfers the force into each of the respective linkages 140 to which they are attached to. Since the slider 120 and corresponding linkage point are constrained to slide within a slot in the base 110, the ends of the linkages 140 are forced to rotate out, away from the center of the base 110 and in a direction substantially orthogonal to the movement direction of the sliders 120. The ends of the linkages 140, pivotably attached to the grabbers 130, push the grabbers 130 out, away from the center of the base 110, into an open position. Each of the grabbers 130, translating orthogonally to the sliders 120, rides on a sloped, or formed surface, such that the movement of each of the grabbers 130 is out and down away from the base 110. In this open position, the user then positions the cleaning apparatus 100 on top of the clean pad so that the bottom of the cleaning apparatus 100 is positioned over the pad and the grippers 133 of the grabbers 130 are in contact with the top of the clean pad. Once in contact with the clean pad, the user releases the force applied to the actuator such that the grabbers 130 are pulled back into the closed position by action of the spring element 150—or also aided in whole or in part by a reverse force applied to the actuator 20. The motion of the grabbers 130 pulling back into position pulls the gripped portion of pad along with it and pinches the gripped portion of the pad between the grabber 130 and the base 110. The pad is now loaded and constrained to the cleaning device 100.

Once finished cleaning, the user would reverse the action to release the pad, actuating the sliders 120 to place the grabbers 130 in the open position, thereby releasing the pad.

Example 2

In another example, an embodiment of the cleaning apparatus 100 includes a handle 10 and actuator 20 as shown in FIG. 1. In this embodiment, a user is able to place the apparatus on a cleaning pad, such that the contact pad 40 is in contact with the cleaning pad. The user then pushes down on the handle 10, which imparts a force to the sliders 120 via the actuator 20, and the grabbers 130 open. Since the grabbers 130 are spring-loaded, via the spring element 150, when the user releases the downward pressure on the handle 10, the grabbers 130 retract to the closed position and the grippers 133 pull the cleaning pad up to be captured between the grippers 133 and the base 110. FIGS. 26A through 26G illustrate how the cleaning apparatus 100 "grabs" a pad.

Example 3

In another example, an embodiment of the cleaning apparatus 100 includes a slider 120 that actuates the grabbers 130 via a rotary motion. The user places the cleaning apparatus 100, as before, above a pad. Rotating the slider 120 causes the grabbers 130 to extend from the base 110 and expose the grippers 133. The user places the cleaning apparatus 100 so that the base 110 and grippers 133 are in contact with the pad and applies a counter-rotation to the slider 120, thereby causing the grabbers 130 to retract to a closed position and pinch the pad between the grabbers 130 and the base 110.

Example 4

Figure 19:
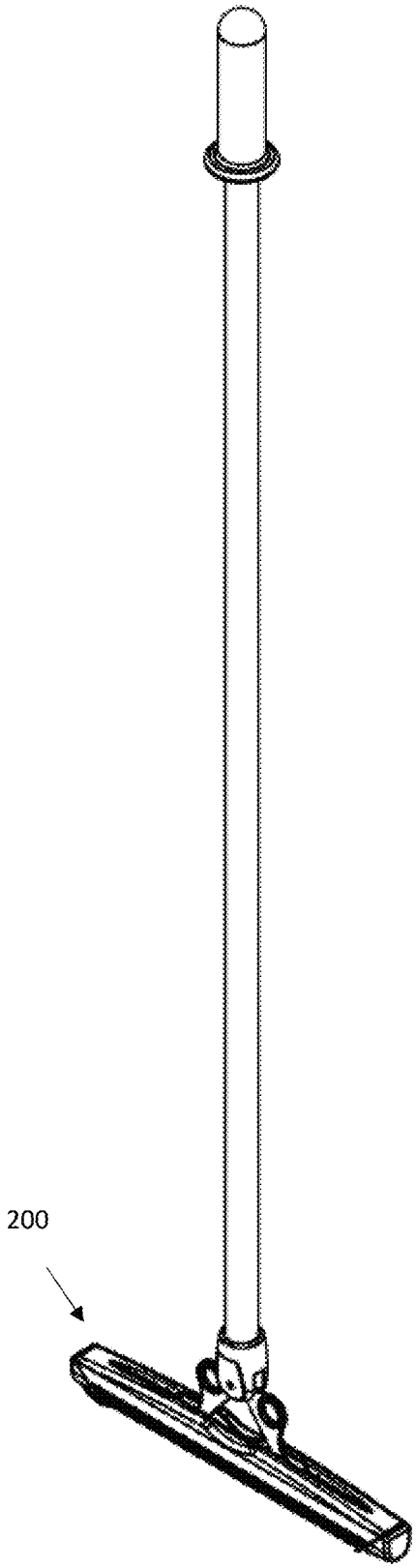
FIG. 19 shows an example of a T-mop embodiment of the invention, including a handle, with the mechanism in the closed state.
Figure 20:
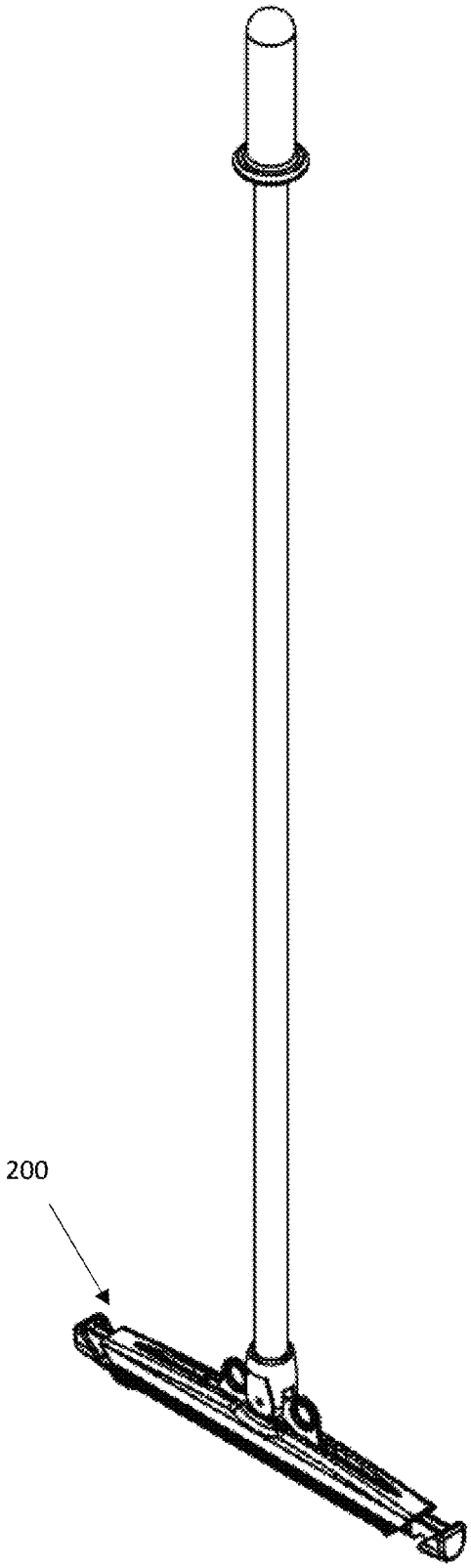
FIG. 20 shows an example of a T-mop embodiment of the invention, including a handle, with the mechanism in the open state.
Figure 21:
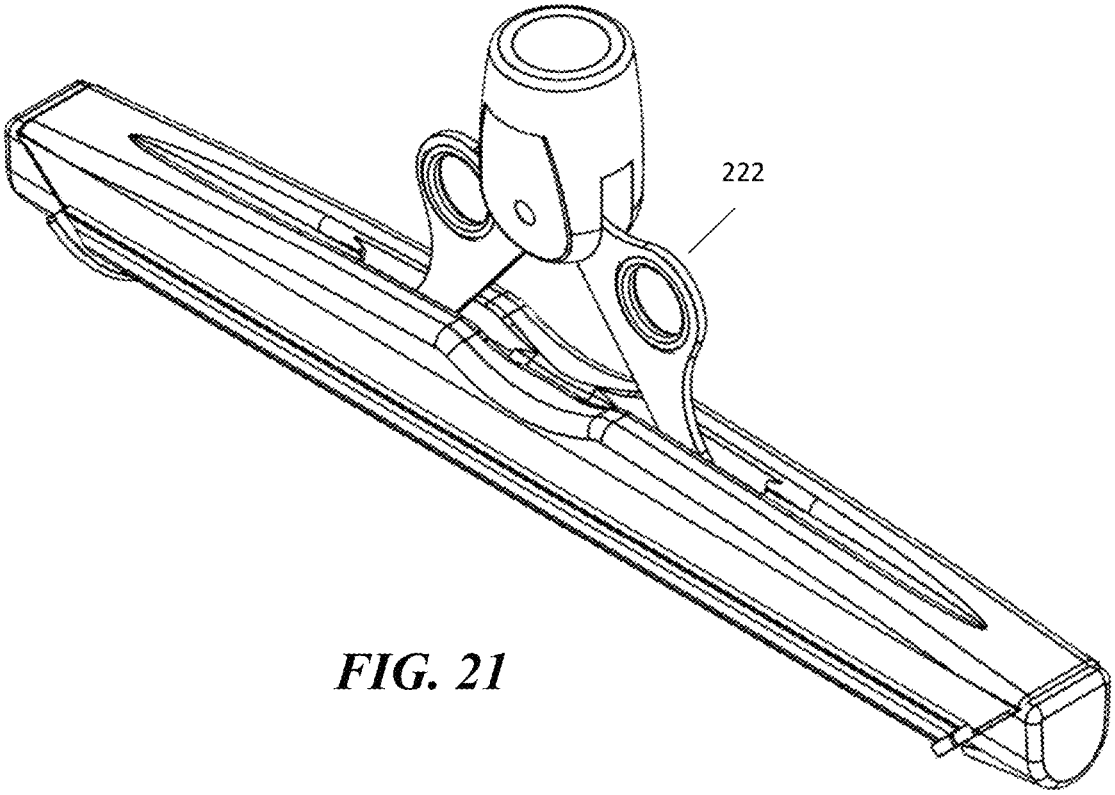
FIG. 21 shows a top isometric view of the T-mop mechanism in the closed state, according to an embodiment of the invention.
Figure 22:
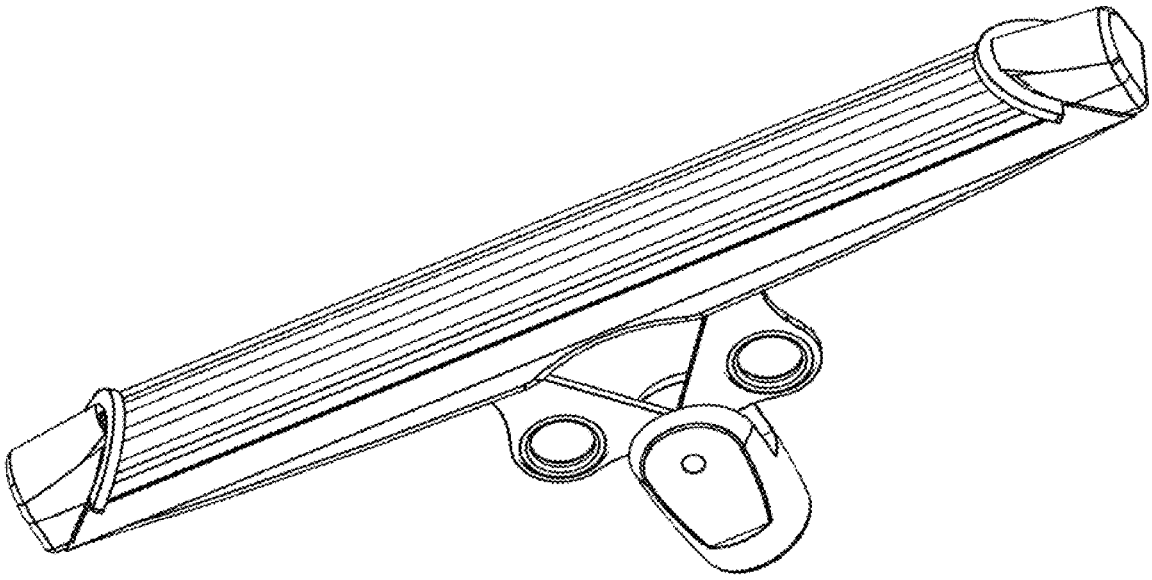
FIG. 22 shows a bottom isometric view of the T-mop mechanism in the closed state, according to an embodiment of the invention.
Figure 23:
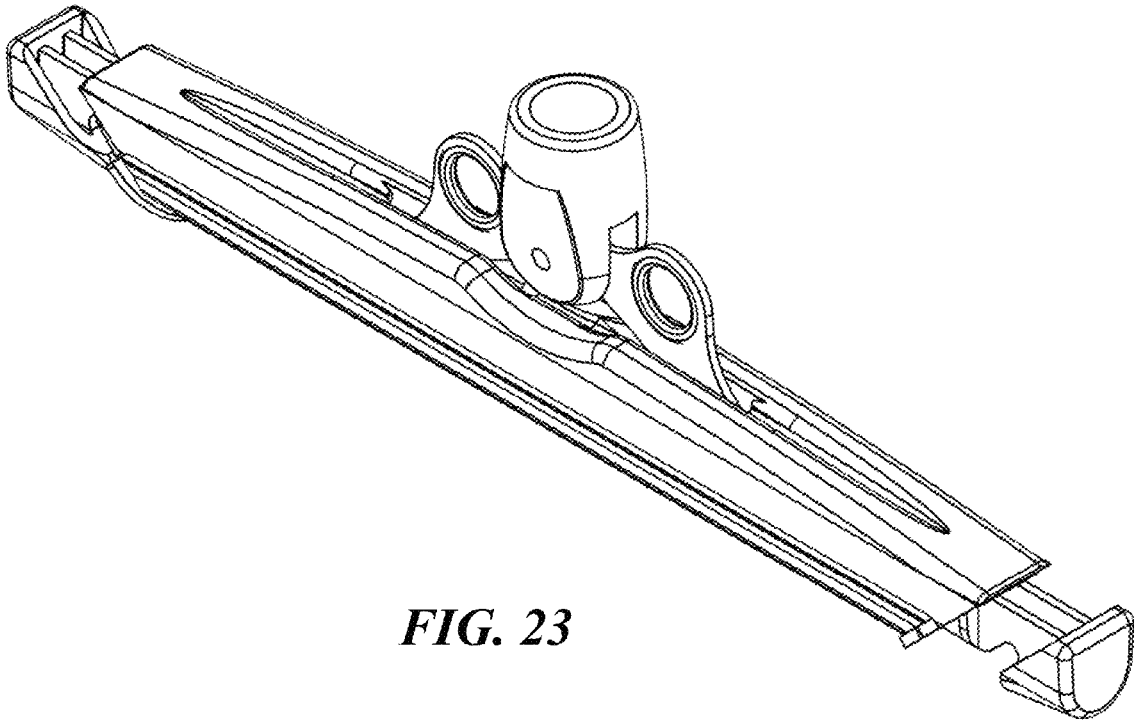
FIG. 23 shows a top isometric view of the T-mop mechanism in the open state, according to an embodiment of the invention.
Figure 24:
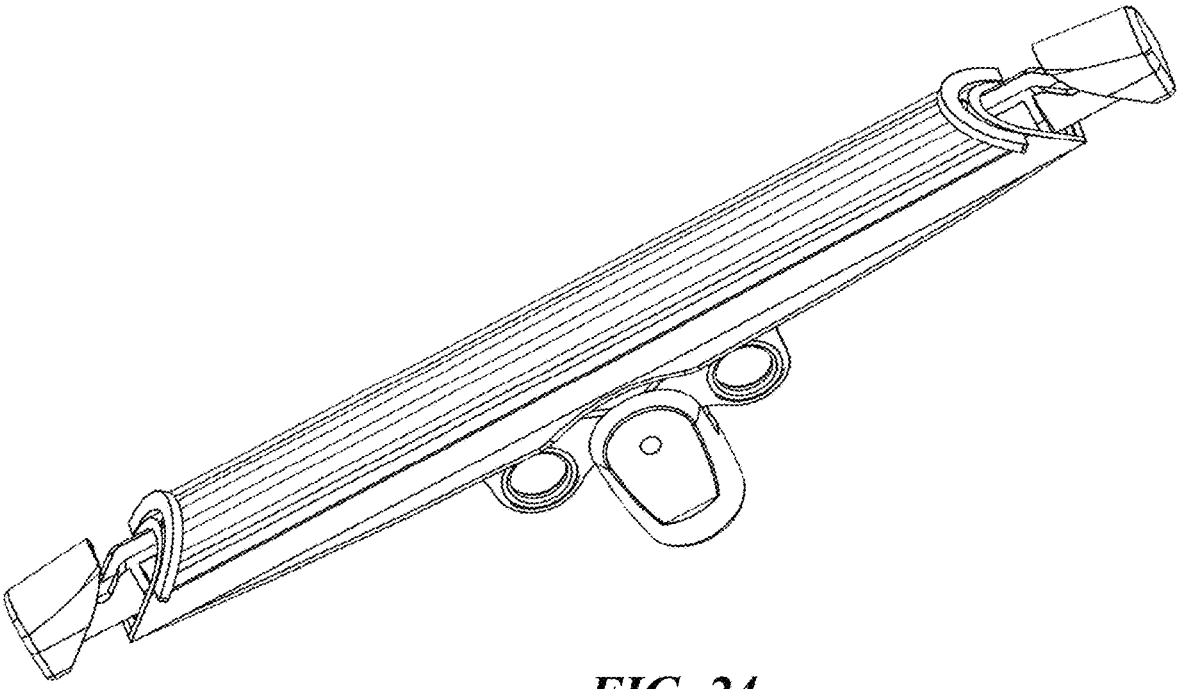
FIG. 24 shows a bottom isometric view of the T-mop mechanism in the open state, according to an embodiment of the invention.
Figure 25:
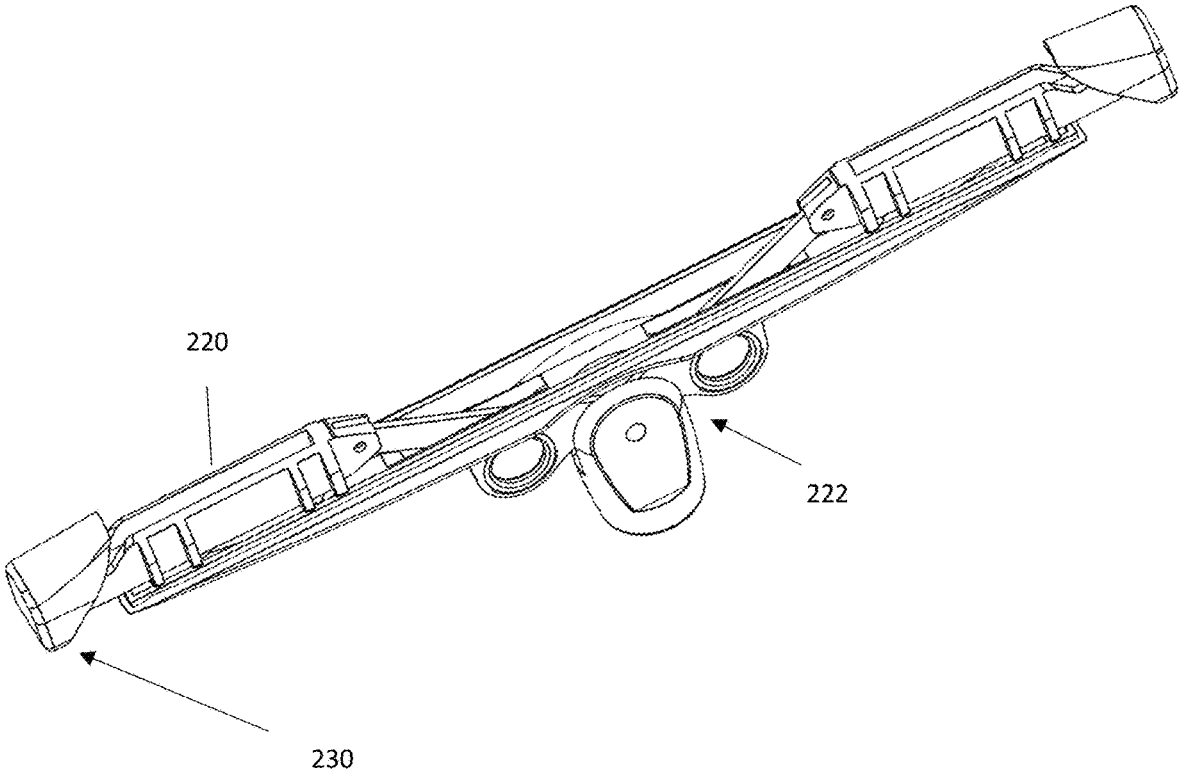
FIG. 25 shows a bottom isometric view of the T-mop mechanism in the open state with the bottom cover removed to show interior components, according to an embodiment of the invention.
Figure 26A:
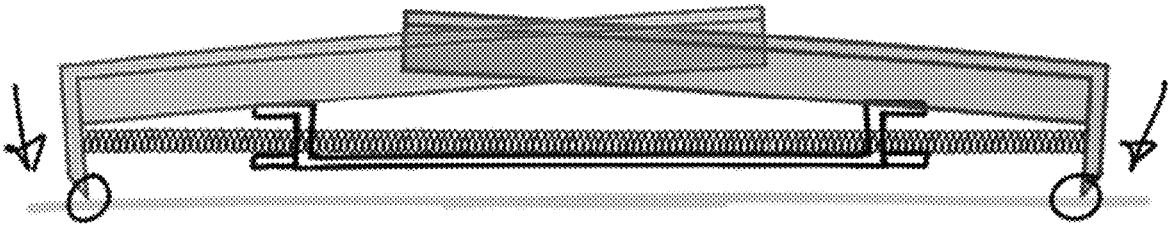
FIGS. 26A, 26B, 26C, 26D, 26E, 26F, 26G show a composite view of the operation of the cleaning apparatus, according to an embodiment of the invention.
Figure 26B:
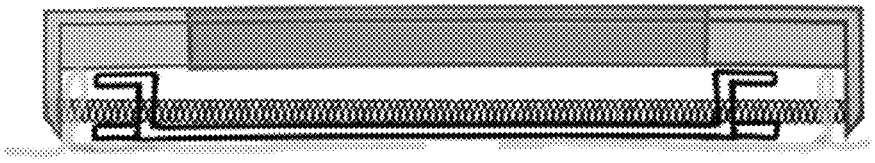
Figure 26C:
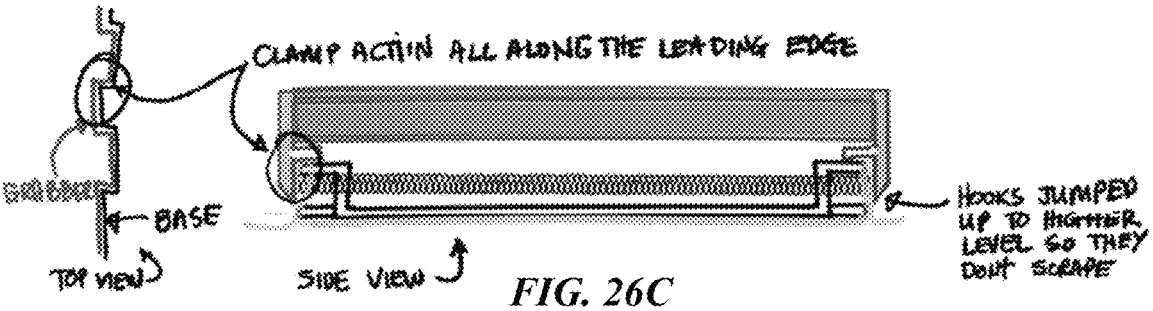
Figure 26D:
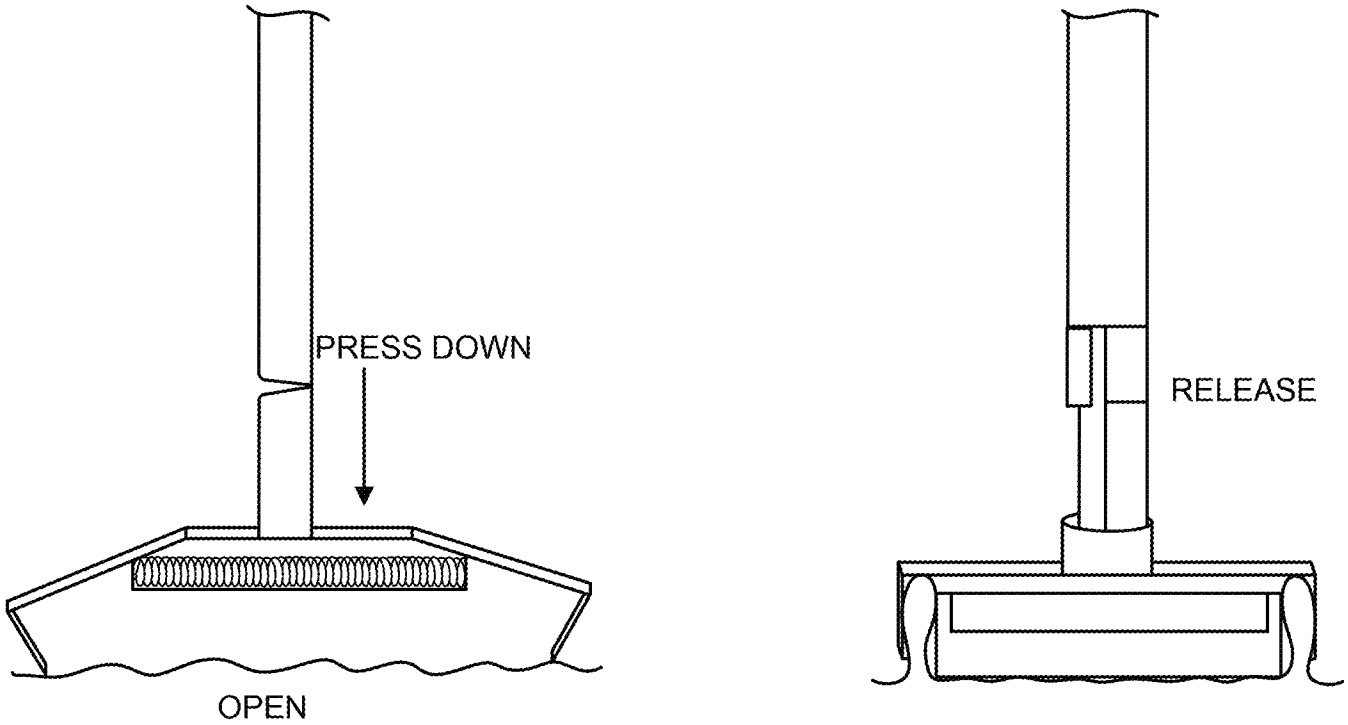
Figure 26G:
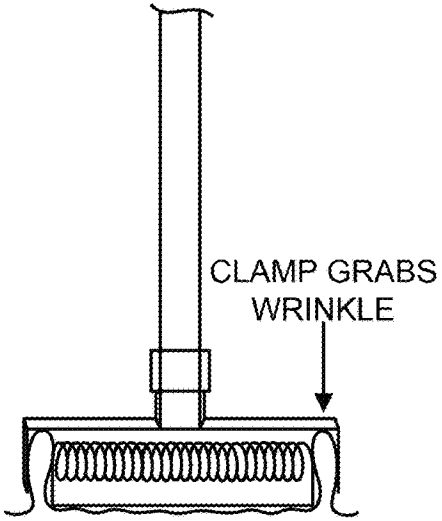
Figure 26F:
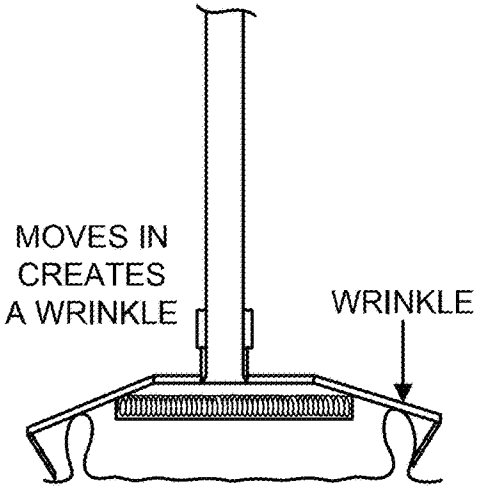
Figure 26E:
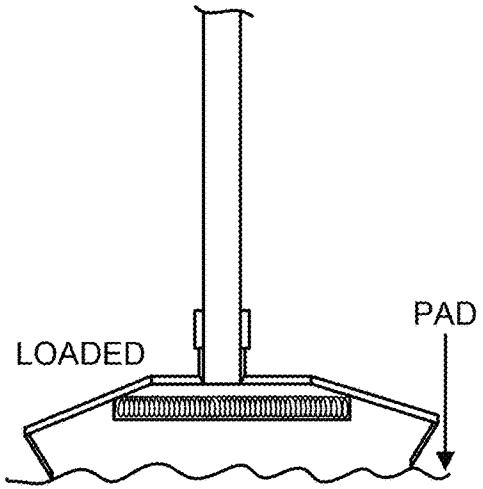
Figure 27:
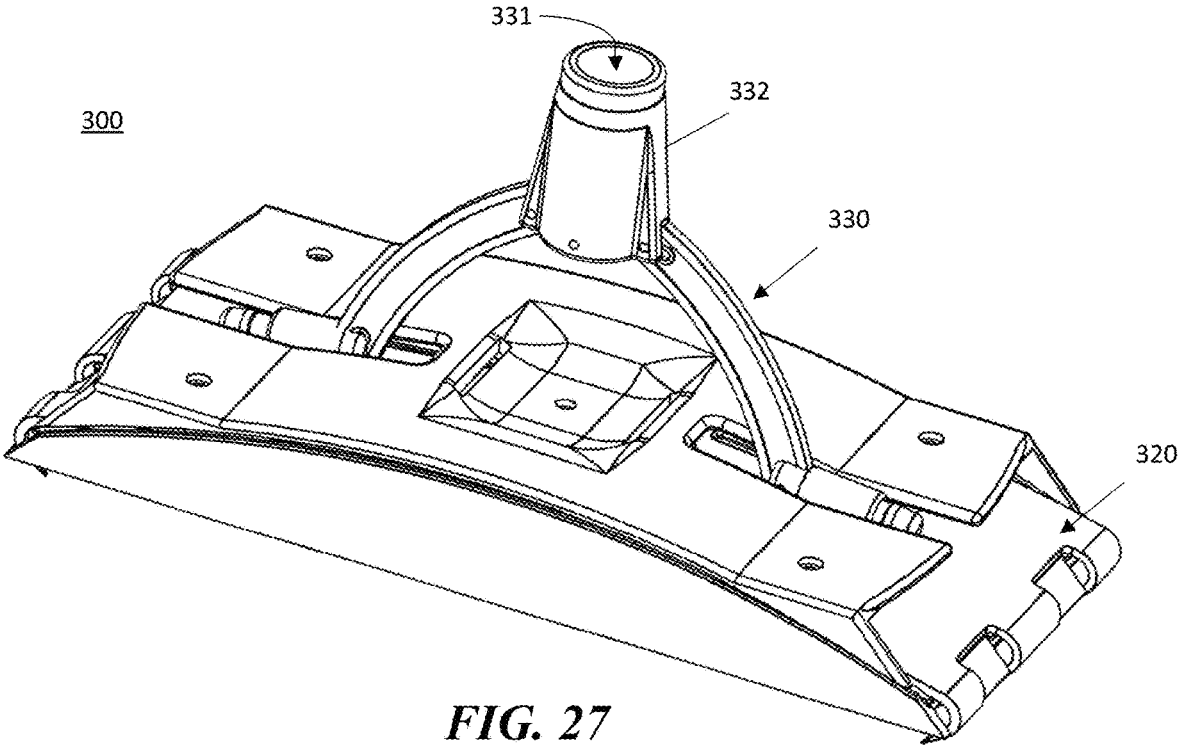
FIG. 27 shows an example of a push mop cleaning apparatus, according to an embodiment of the invention.

Another example, is shown in FIGS. 19-25. Shown here is an embodiment of the invention in the form of a t-mop 200. FIG. 19 shows the t-mop 200 in the closed state and FIG. 20 shows the t-mop 200 in the open state. In this embodiment, a user may push down on the handle (or alternatively push on the finger-rings 222) in order to push a left and right slider each outward. At the end of each slider 220 is attached a grabber 230. As in other embodiments, a force applied to the slider(s) is used to translate a one or more grabber between a closed and open position.

Example 5

In another exemplary embodiment of the invention, the apparatus is shown in FIGS. 27-31 as push mop 300. Push mop 300 is comprised of a base 310, a left and right combined slider-grabber 320, and an actuator 330. In this embodiment, combined slider-grabber 320 (detailed in FIGS. 30 and 31) is comprised of a slider portion 321 on the proximal end and a grabber portion 322 on the distal end. This unitary grabber-slider 320 is still within the scope of the present invention as a force applied to the slider 321 is transferred to the grabber 322 to cause the grabber 322 to move between an open state and a closed state. Since the slider 321 and grabber 322 are combined into one component 320, however, intermediary linkages are not required in this embodiment. The actuator 330 is pivotably attached to each of the left and right grabber-slider 320, such that a downward force applied to the apex 331 (not shown) of the actuator 330 is distributed to the grabber-slider 320 at the slider portion 321. A handle receiver 332 is attached to the apex 331 of the actuator 330 and is configured to receive a handle (not shown).

Further, in view of many embodiments to which the principles of the invention may be applied, it should be understood that the illustrated embodiments are exemplary embodiments and should not limit the present disclosure. Features and components from one embodiment can be used with other embodiments.

Therefore, while there has been described what is presently considered to be the preferred embodiment, it will be understood by those skilled in the art that other modifications can be made within the spirit of the disclosure. The above description(s) of embodiment(s) is not intended to be exhaustive or limiting in scope. The embodiment(s), as described, were chosen in order to explain the principles of the invention, show its practical application, and enable those with ordinary skill in the art to understand how to make and use the invention. A component from one embodiment can be used with another embodiment. It should be understood that the invention is not limited to the embodiment(s) described above, but rather should be interpreted within the full meaning and scope of the disclosure.

The invention claimed is:

1. A cleaning apparatus selectably movable between a closed position and an open position, the cleaning apparatus comprising:

a base;

a slider attached to the base, the slider configured with an actuation point where a force may be exerted in order to translate the slider linearly and longitudinally relative to the base; and a grabber attached to the base and to the slider, and configured such that a movement of the slider along a linear path relative to the base is translated into a movement of the grabber relative to the base, selectively between the closed position and the open position, wherein the slider remains substantially parallel to the base during its movement, where at least a portion of the grabber sits above the base while in the closed position and the portion of the grabber sits below the base while in the open position.

2. The cleaning apparatus of claim 1, further comprising a contact pad attached to the base.

3. The cleaning apparatus of claim 1, further comprising a handle.

4. The cleaning apparatus of claim 1, further comprising a cleaning pad.

5. The cleaning apparatus of claim 1, further comprising a one or more actuator connected to the slider such that a force applied to the one or more actuator is translated to the slider, wherein the actuator is configured to move the slider in a linear path along the base.

6. The cleaning apparatus of claim 5, further comprising a universal joint connected to the one or more actuator.

7. The cleaning apparatus of claim 6, further comprising a handle removably connected to the universal joint.

8. A method of using the cleaning apparatus of claim 7, the method comprising the steps of:

providing a cleaning pad;

positioning the cleaning apparatus, in a closed state, over the cleaning pad such that the base of the cleaning apparatus is in mated relation to the cleaning pad;

applying a force to the actuator, such that the force is translated through the one or more actuator to the slider, translating the slider longitudinally relative to the base causing the grabber to translate to an open state, whereby a portion of the grabber translates below the base of the cleaning apparatus, thereby engaging with the cleaning pad; and releasing the force on the actuator, whereby the grabber pulls back to the closed state, the portion of the grabber translating back above the base, dragging the cleaning pad with it and pinching it between the grabber and the base.

9. A cleaning system comprising:

a cleaning apparatus, the cleaning apparatus comprising: a base; a slider attached to the base, the slider configured with an actuation point where a force may be exerted to translate the slider linearly along a longitudinal axis relative to the base; and a grabber attached to the base and to the slider, configured such that the linear longitudinal movement of the slider relative to the base is translated into a linear movement of the grabber between an open position and a closed position relative to the base, where the grabber remains in a parallel plane relative to the base during its movement and is positioned above the base in the closed position and below the base in the open position; and a pad, whereby the system enables a user to pick up the pad by clinching the pad in the cleaning apparatus between the grabber and the base in the closed position, and then release the pad by moving the cleaning apparatus into the open position.

10. The cleaning system of claim 9 further comprising a handle, wherein the handle is configured to attach to the cleaning apparatus.

* * * * *